US007103918B2

(12) United States Patent
Isom et al.

(10) Patent No.: US 7,103,918 B2
(45) Date of Patent: Sep. 12, 2006

(54) HAND COVERING

(75) Inventors: Matthew Isom, Baltimore, MD (US); Brian E. Le Gette, Baltimore, MD (US); Alan Tipp, Baltimore, MD (US); Justin Saul Werner, Millersville, MD (US); Ronald L. Wilson, II, Catonsville, MD (US)

(73) Assignee: 180s, Inc., Baltimore, MD (US)

( * ) Notice: Subject to any disclaimer, the term of this patent is extended or adjusted under 35 U.S.C. 154(b) by 178 days.

(21) Appl. No.: 10/062,508

(22) Filed: Feb. 5, 2002

(65) Prior Publication Data

US 2003/0145367 A1 Aug. 7, 2003

(51) Int. Cl.
*A41D 19/00* (2006.01)

(52) U.S. Cl. ..... 2/159; 2/161.6

(58) Field of Classification Search ..... 2/16, 2/20, 158, 159, 160, 161.1, 161.6, 163, 164, 2/161.5, 162, DIG. 3; 219/211, 548, 549; 607/111

See application file for complete search history.

(56) References Cited

U.S. PATENT DOCUMENTS

| | | | | | |
|---|---|---|---|---|---|
| 2,842,771 | A | | 7/1958 | Foti | |
| 3,121,877 | A | * | 2/1964 | Gintner | 2/159 |
| 3,259,914 | A | * | 7/1966 | Johnson | 2/161.6 |
| 3,649,966 | A | * | 3/1972 | Shields | |
| 3,706,102 | A | | 12/1972 | Grenier | |
| 3,992,723 | A | | 11/1976 | Lazanas | |
| 4,021,640 | A | * | 5/1977 | Gross et al. | 2/159 |
| 4,965,886 | A | | 10/1990 | Ockels | |
| 5,025,502 | A | | 6/1991 | Raymond et al. | |
| 5,120,304 | A | | 6/1992 | Sasaki | |
| 5,345,609 | A | | 9/1994 | Fabry et al. | |
| 5,832,539 | A | | 11/1998 | Williams | |
| 5,833,915 | A | * | 11/1998 | Shah | 156/272.2 |
| 6,009,713 | A | | 1/2000 | Horn | |
| 6,055,670 | A | | 5/2000 | Parker | |
| 6,060,693 | A | * | 5/2000 | Brown | 2/160 |

FOREIGN PATENT DOCUMENTS

| | | | |
|---|---|---|---|
| DE | 1 839 911 | | 10/1961 |
| DE | 3301231 | A1 * | 7/1984 |
| DE | 3326085 | A1 | 4/1985 |
| DE | 3619180 | A1 * | 12/1987 |
| FR | 2 089 036 | | 1/1972 |
| FR | 2 124 257 | | 9/1972 |
| FR | 2 206 916 | | 6/1974 |
| JP | 7-1852074 | | 1/1995 |
| WO | PCT/US92/03007 | * | 10/1992 |
| WO | WO 01/74186 | A2 | 10/2001 |

OTHER PUBLICATIONS

Outdoor Retailer's Newsbytes, "Gore Gives New Inflatable Insulation a Public Airing", www.outdoorretailer.com/or_main/news/archive/200112.htm, Dec. 12, 2001, pp. 1, 2 and 21.

Formulative Enveloppe Soleau, dated Nov. 9, 2001, 1 page.

* cited by examiner

*Primary Examiner*—Gary L. Welch
(74) *Attorney, Agent, or Firm*—Cooley Godward LLP

(57) ABSTRACT

A hand covering including a hand receiving portion that is closed at a first end and that defines an opening at a second end. A cover is coupled to the hand receiving portion and an air distribution device is disposed between the cover and the hand receiving portion. The air distribution device has an inlet and outlet that are positioned in a spaced apart relationship.

51 Claims, 33 Drawing Sheets

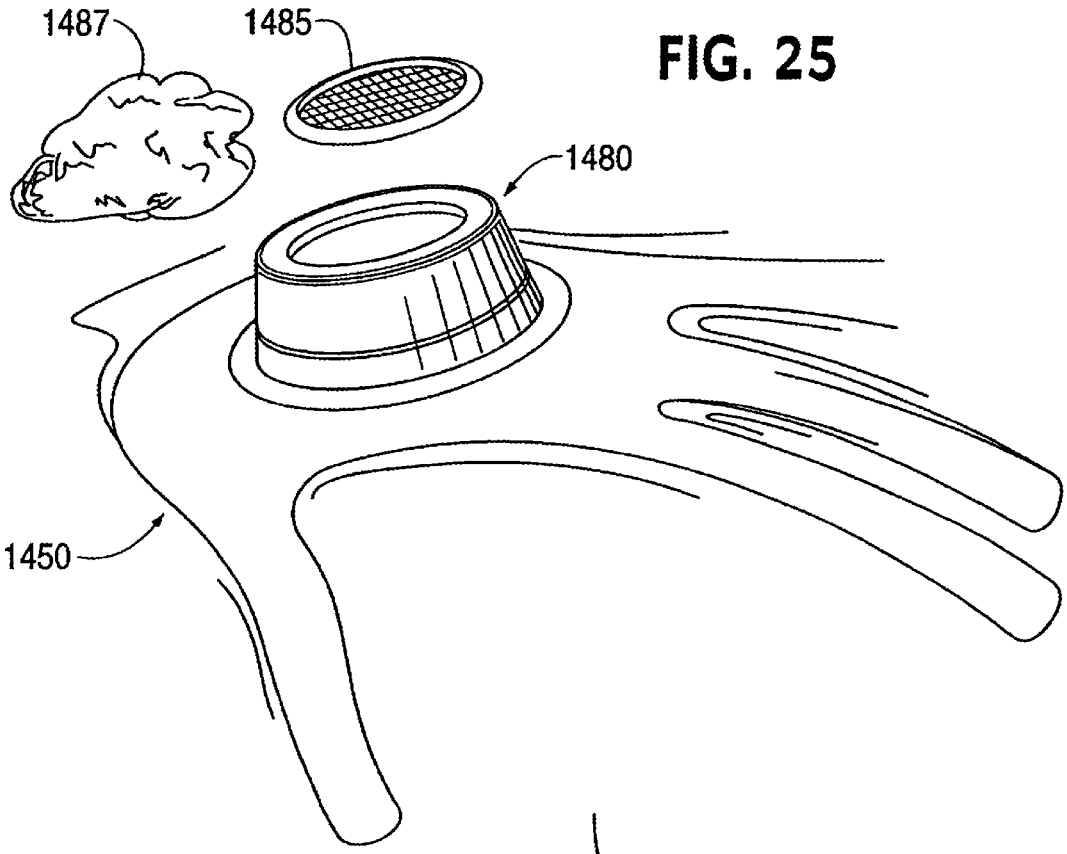
FIG. 25
FIG. 26
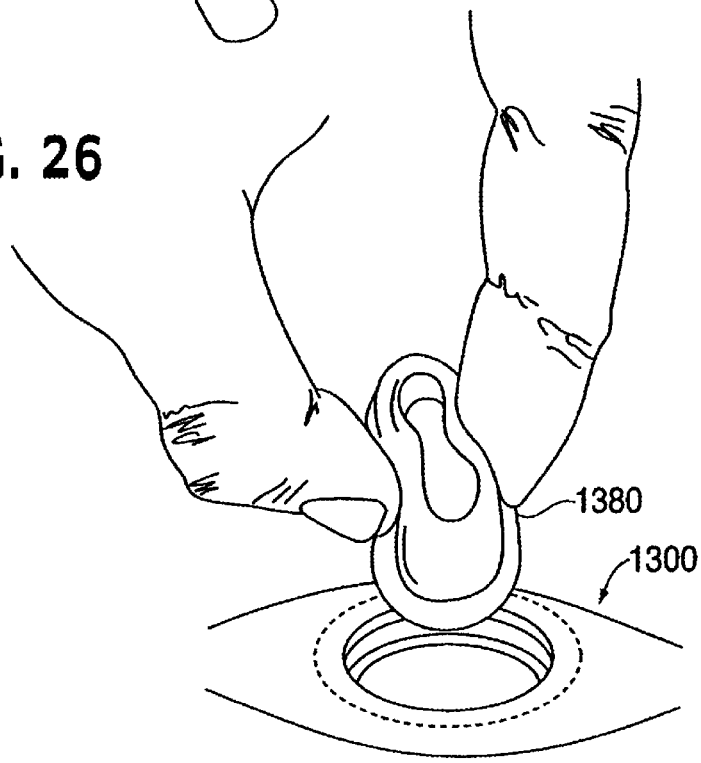

HAND COVERING

BACKGROUND

1. Field of the Invention

The present invention relates generally to hand coverings and more particularly to a hand covering with internal thermal tubes.

2. Discussion of the Related Art

In cold weather, it is often desirable to keep one's hands warm by wearing gloves or similar hand coverings. A concern arises when, during extreme temperature conditions, it is difficult to maintain ones hands at a comfortable temperature regardless of whether or not one is wearing such hand coverings. Accordingly, hand coverings have been provided that allow a user to warm their hands beyond the temperature which is provided by simply wearing the hand covering.

Hand coverings have been provided that allow the wearer to introduce heat into the interior of the hand covering. Such hand coverings typically allow the heat to dissipate throughout the entire interior chamber of the hand covering. A problem with such hard coverings is that the heat dissipates quickly and the extremities (i.e., the fingertips) often do not receive the warm air and therefore remain at an uncomfortable, cold temperature. This is a concern because extremities are typically the first part of the body to get cold and are also the most difficult to warm up once they have become cold.

Other hand coverings have been provided that allow air to be ventilated through the chamber of the hand covering in which the hand is placed to allow for air flow and greater comfort for the wearer.

What is needed is an improved hand covering that communicates warm air to the extremities of the wearer's hand without dissipation of the warm air between an inlet and an outlet and allows for adequate ventilation.

SUMMARY OF THE INVENTION

A hand covering includes a hand receiving portion that is closed at a first end and that defines an opening at a second end. A cover is coupled to the hand receiving portion and an air distribution device is disposed between the cover and the hand receiving portion. The air distribution device has an inlet and outlet that are positioned in a spaced apart relationship.

In another embodiment of the present invention, the hand covering includes a first layer, a second layer coupled to the first layer, multiple channeling members defined between the first and second layers and an air intake configured to direct air to each of the inlets of the channeling members. Each channeling member includes an inlet and is configured to communicate air to its own outlet.

In a further embodiment of the present invention, a method of manufacturing a hand covering is provided. The method includes coupling a first membrane to a second membrane to form an air distribution device. The air distribution device is positioned adjacent a first layer of the hand covering. A second layer of the hand covering is then positioned adjacent the first layer such that the air distribution device is substantially encapsulated between the first and second layer. An air conduit is coupled adjacent to an inlet of the air distribution device.

These and other aspects of the present invention will become apparent from the following drawings and description.

BRIEF DESCRIPTION OF THE DRAWINGS

The present invention is described with reference to the accompanying drawings. In the drawings, like reference numbers indicate identical or functionally similar elements.

FIGS. 24 through 40 illustrate alternative embodiments of the air conduit according to the present invention.

DETAILED DESCRIPTION

Figure 1:
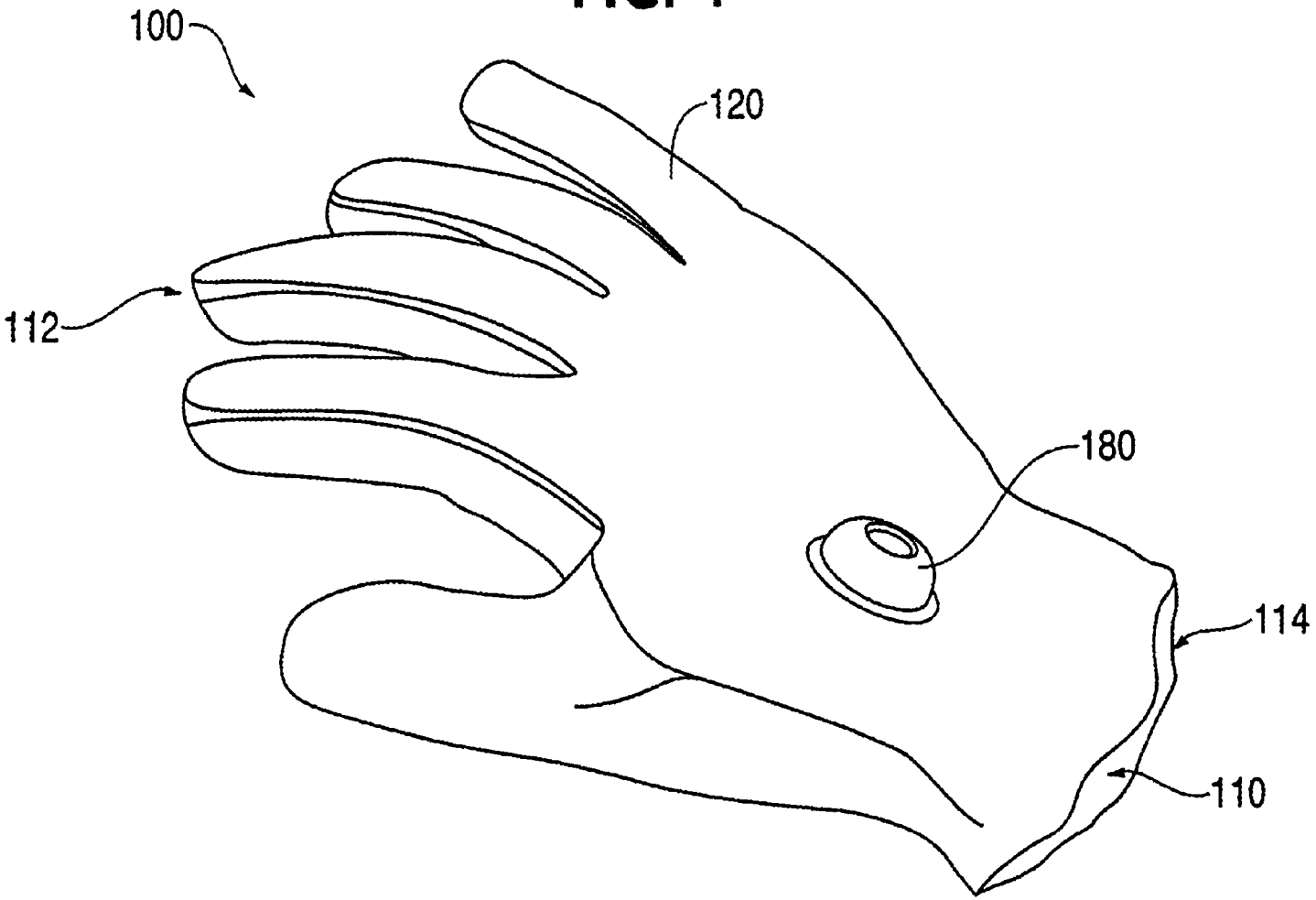
FIG. 1 illustrates a perspective view of a hand covering according to an embodiment of the present invention.
Figure 2:
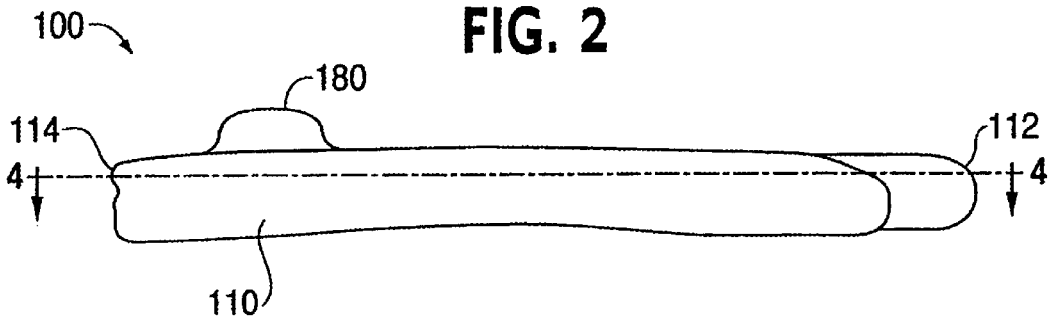
FIG. 2 is a side view of the hand covering illustrated in FIG. 1.
Figure 3:
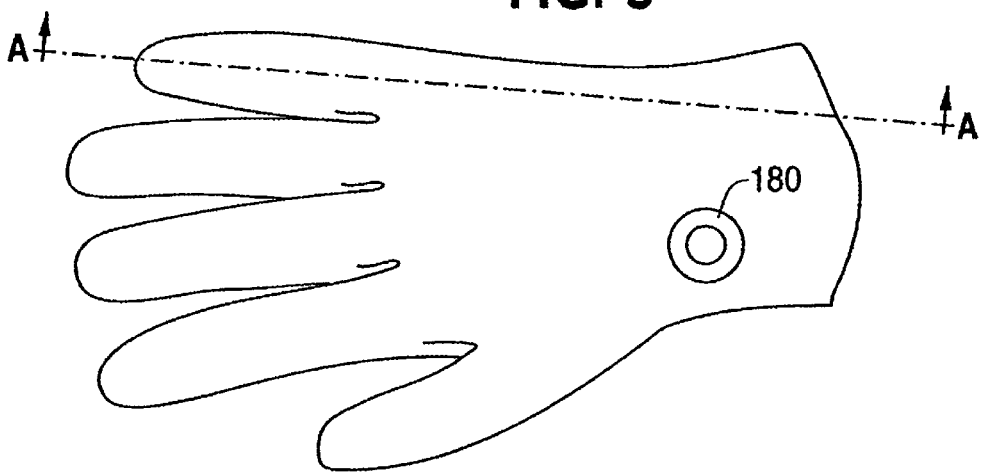
FIG. 3 is a top view of the hand covering illustrated in FIG. 1.
Figure 5:
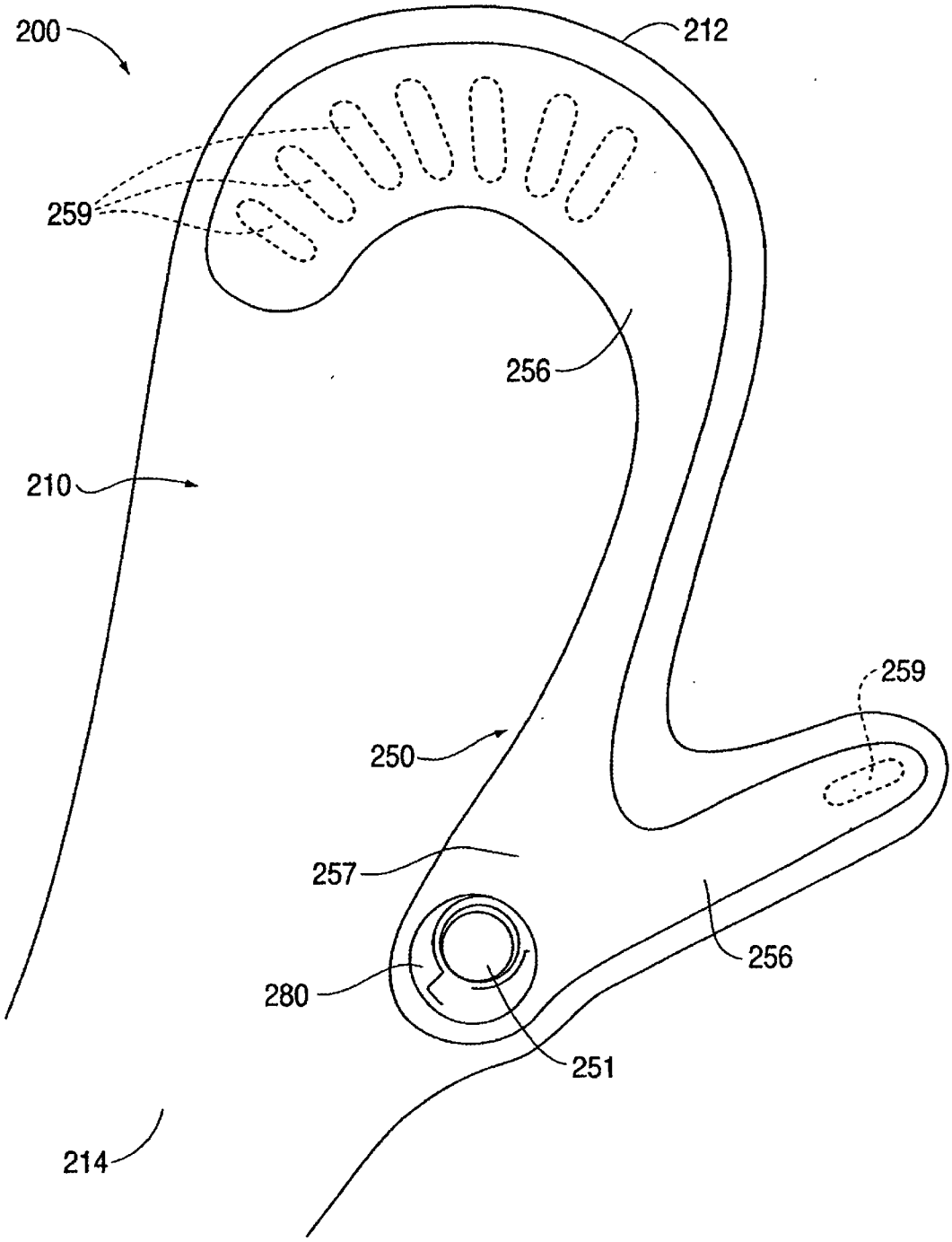
FIG. 5 illustrates a cross sectional view of an alternative embodiment of a hand covering present invention.

A hand covering is configured to distribute air from an inlet to at least one outlet that is spaced apart from the inlet. The outlet is spaced apart from the inlet such that air is distributed to the extremities of the hand covering without dissipating throughout the hand covering. FIGS. 1–3 illustrate an embodiment of a hand covering 100. The hand covering 100 is comprised of multiple layers and includes a first layer or hand receiving portion 110 that is closed at a first end 112 and defines an opening at a second end 114. The hand receiving portion defines a cavity 115 (not shown in FIG. 1) that is configured to receive the hand of a user. While the hand covering 100 is illustrated in FIG. 1 as a glove, it will be appreciated that other hand coverings such as mittens (as illustrated in FIG. 5) or mitten and glove combinations, are also possible.

A second layer or cover 120 is coupled to the hand receiving portion 110 and an air distribution device 150 (not shown in FIG. 1) is disposed between the cover 120 and the hand receiving portion 110. The cover 120 is provided to substantially encapsulate the air distribution device 150. Depending upon whether the air distribution device is positioned outside or inside the hand receiving portion 110, the cover 120 is positioned either inside or outside the hand receiving portion 110 accordingly.

Figure 4:
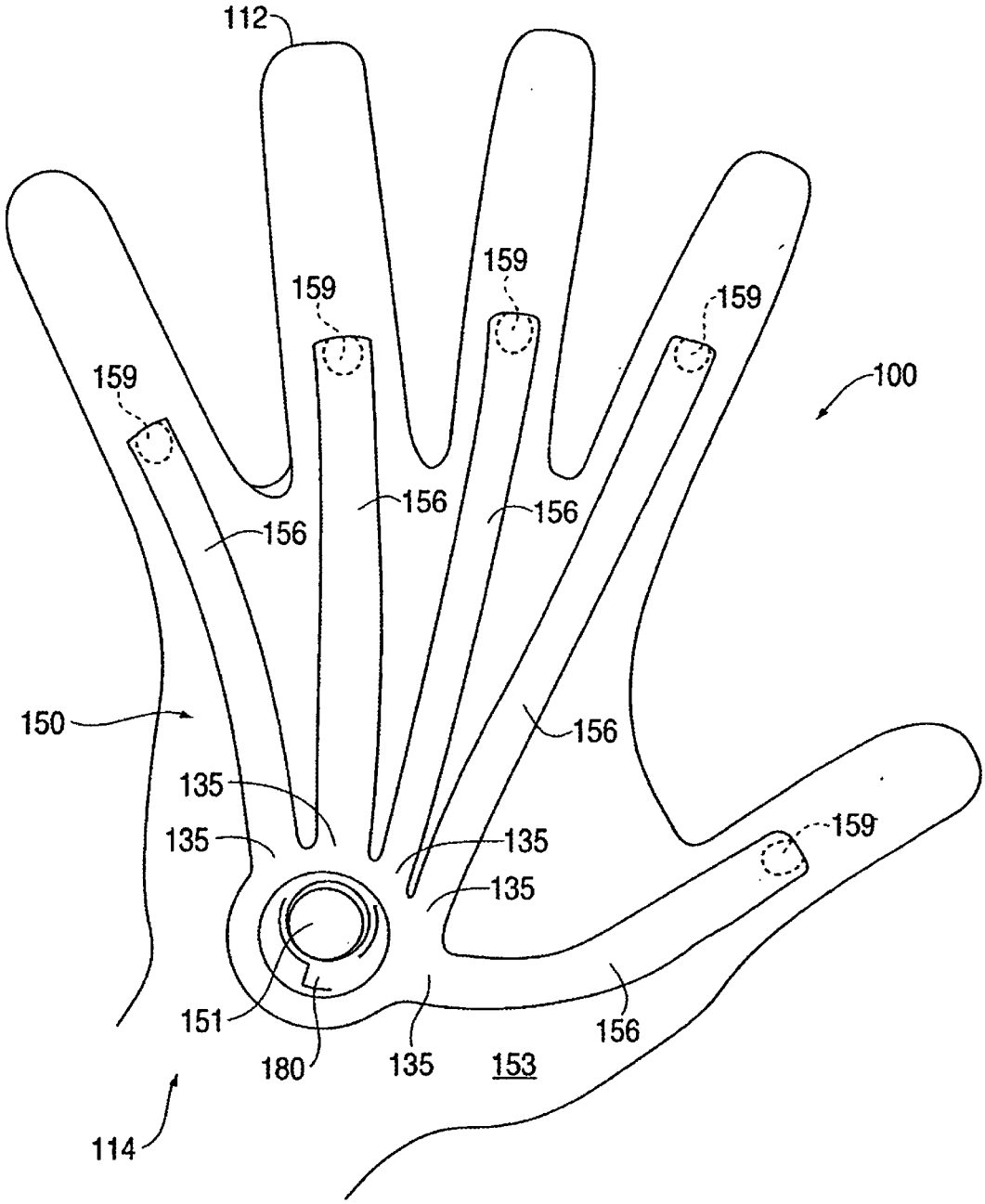
FIG. 4 illustrates a cross sectional view of the hand covering illustrated in FIG. 1 taken along the line 4—4 in FIG. 2.

The air distribution device 150 is configured to communicate air from an inlet 151 to at least one outlet 159 (see FIG. 4). The inlet 151 and outlet 159 are positioned in a spaced apart relation such that the air introduced into the inlet travels over a length before exiting at the outlet 159. As discussed above, the air is to be distributed through the hand covering such that the extremities of the user are contacted by exhausted air while minimizing the dissipation of heat throughout the other portions of the hand covering.

The temperature and pressure of the air at the inlet 151 can be substantially the same as the temperature and pressure of the air at the outlet 159. Depending upon the relative sizes of the inlet 151 and outlet 159, and the size of the channels through which the air flows (described in detail below) the pressure differential between the inlet 151 and outlet 159 may vary (i.e., be greater or lesser pressure at the outlet than at the inlet).

The air distribution device 150 is disposed within the hand covering 100 such that the outlet 159 is positioned proximate the closed end 112 of the hand receiving portion 110. Accordingly, the air will be directed to the extremities of the user as desired.

An air conduit or air intake 180 is provided to facilitate the introduction of air into the air distribution device 150. In the illustrated embodiment, the air conduit 180 is configured as a mouthpiece into which the user can blow to introduce air into the air distribution device 150. As will be appreciated, the air conduit 180 may take many other forms as illustrated in FIGS. 22 through 39. Regardless of the form of air conduit 180, the air conduit 180 is configured to be in gaseous communication with inlet 151 of the air distribution device 150.

The cover 120 defines an opening (not illustrated) that is positioned in registry with the inlet 151 of the air distribution device 150. The air conduit 180 is in gaseous communication with the inlet and can be positioned in registry with the opening in the cover 120. The air conduit can be coupled directly to the cover 120, or alternatively, coupled directly to the air distribution device 150. Alternatively, there may be no air conduit 180 and there may simply be an opening in the cover 120 of the hand covering 100. In a further alternative embodiment, there is no opening in the cover 120 and the user provides air through the cover to an air conduit.

Referring to FIGS. 4 through 9, various embodiments of the air distribution device of the present invention are illustrated. It will be appreciated that the general construction of the embodiments of the air distribution devices 150, 250, 350, 450, 550, 650, 750 are substantially similar and will first be described with reference to air distribution device 350 illustrated in FIGS. 6 and 7.

Figure 6:
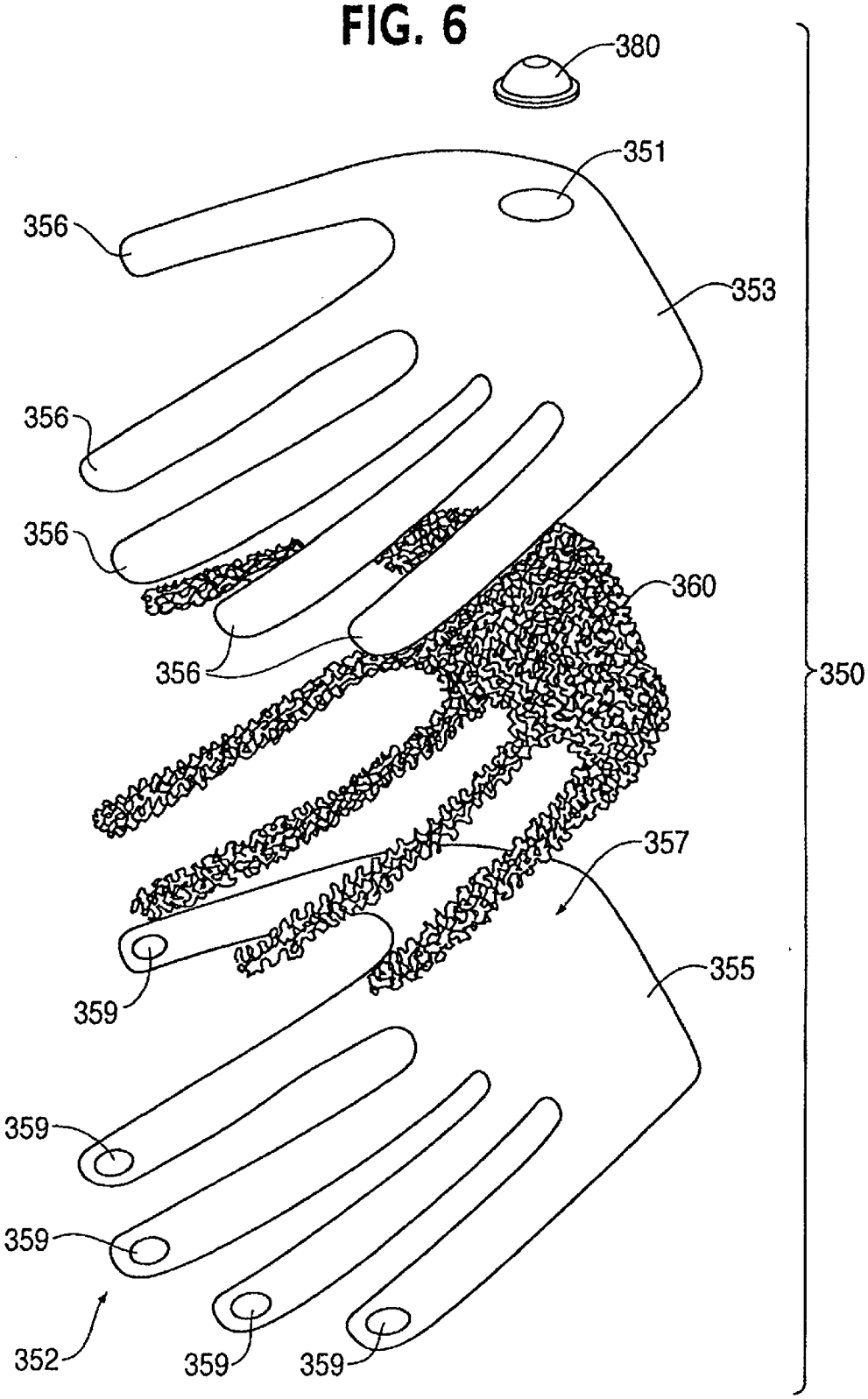
FIG. 6 illustrates an exploded assembly view of an air distribution device according to the present invention.

FIG. 6 illustrates an exploded assembly view of an embodiment of the air distribution device 350 according to an aspect of the present invention. The air distribution device 350 includes a first membrane 353 defining an inlet 351, a second membrane 355 that is coupled to the first membrane 353 and defines at least one outlet 359. The first and second membranes 353, 355 together define an air passage through which air travels from the inlet to the outlet. The outlet 359 is located proximate an end 352 of the second membrane. As described above, the outlets 359 are at an opposite end of the air distribution device 350 from the inlet 351 to properly distribute the air. In this embodiment, the outlets 359 are defined entirely by the second membrane 355. The position and configuration of the inlet 351 and outlets 359 can vary as will be described below. Additionally, the number of inlets and outlets may be varied as desired.

Figure 7:
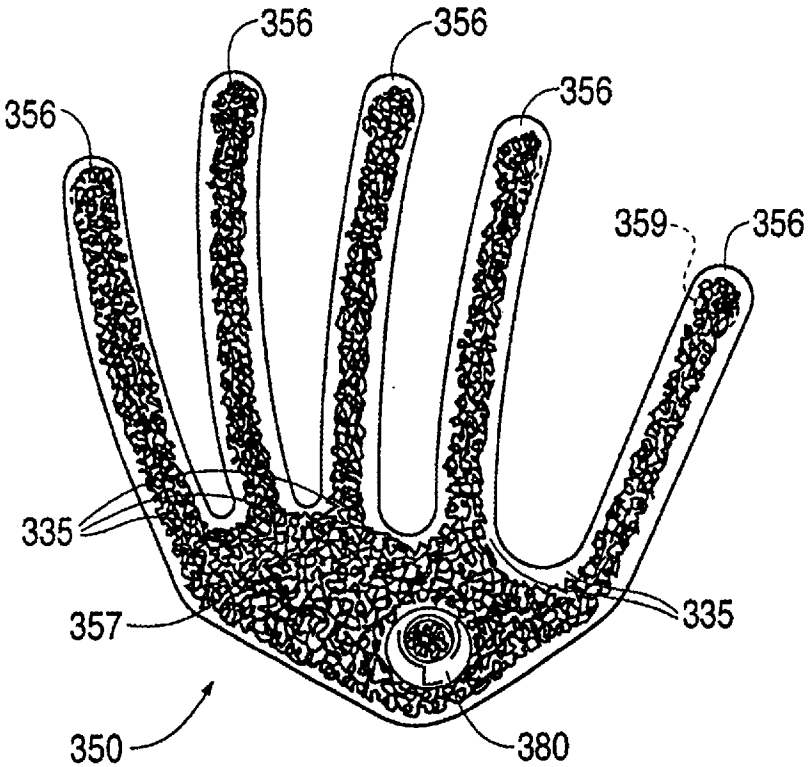
FIG. 7 illustrates an alternative embodiment of an air distribution device according to the present invention.

As shown in FIG. 7, the air distribution device 350 also includes a plurality of channeling members 356. Each channeling member 356 includes its own inlet 335. Air is communicated to the inlet 335 from an air chamber 357. The air chamber 357 is located between the inlet 335 of the channeling members 356 and the inlet 351 defined by the first membrane 353.

In the illustrated embodiment, an air conduit 380 is coupled to the first membrane 353 adjacent to, and in registry with, the inlet 351.

A layer of material 360 is disposed between the first membrane 353 and second membrane 355 within the air passage. The material 360 that is located in the air passage defined by the two membranes 353, 355 can serve many purposes. The material 360 is configured to maintain the air passage open (i.e., prevent the two membranes from sticking together). The material 360 also can serve as a wicking material or desiccant to aid in the drying and distribution of moisture out of the air distribution device. The material 360 can be manufactured, for example, from foam or may be an interwoven porous material. The material 360 in addition to providing a moisture barrier and acting as a wicking material, may also have heat retaining qualities. The material 360 allows only minor dissipation of the heat of the air provided at the inlet, and allows the air to pass through the channeling members 356 at a substantially constant temperature.

Returning to the hand covering 100 of FIG. 4, the embodiment of the air distribution device 150 illustrated in FIG. 4 includes an air conduit 180 coupled to a first membrane 153 of the air distribution device 150 adjacent to the inlet 151. Multiple channeling members 156, each have an inlet 135 and is configured to communicate a gas to its own outlet 159. In the illustrated embodiment, the outlets 159 are shown in dashed lines, indicating that they are located along the length of the side of the air distribution device 150 that is opposite the inlet 151 (i.e., defined entirety by the second membrane). In the embodiment illustrated in FIG. 4, air is provided to the air conduit or air intake 180, and is distributed to inlets 135 and through channeling members 156 until it is ultimately exhausted at the outlets 159. In the illustrated embodiment, there is no air chamber between the air conduit 180 and the channeling members 156 although in other embodiments, an air chamber can be present.

An alternative embodiment of an air distribution device 250 for use with an alternative hand covering 200 having an open end 214 and a closed end 212 is illustrated in FIG. 5. In this embodiment the air distribution device 250 includes an air conduit or air intake 280 that is coupled to the air distribution device 250 adjacent the inlet 251. The air outlets 259 are located adjacent the closed end 212 of the hand covering 200 and are defined by the second membrane (not visible in FIG. 5). As is apparent, two) hanneling members 256 are coupled to an air chamber 257. One of the channeling members 256 includes multiple outlets 259 while the other channeling member 256 includes at single outlet 259. Alternatively, both of the channeling members 256 could include a plurality of outlets or a single outlet 259.

Figure 8:
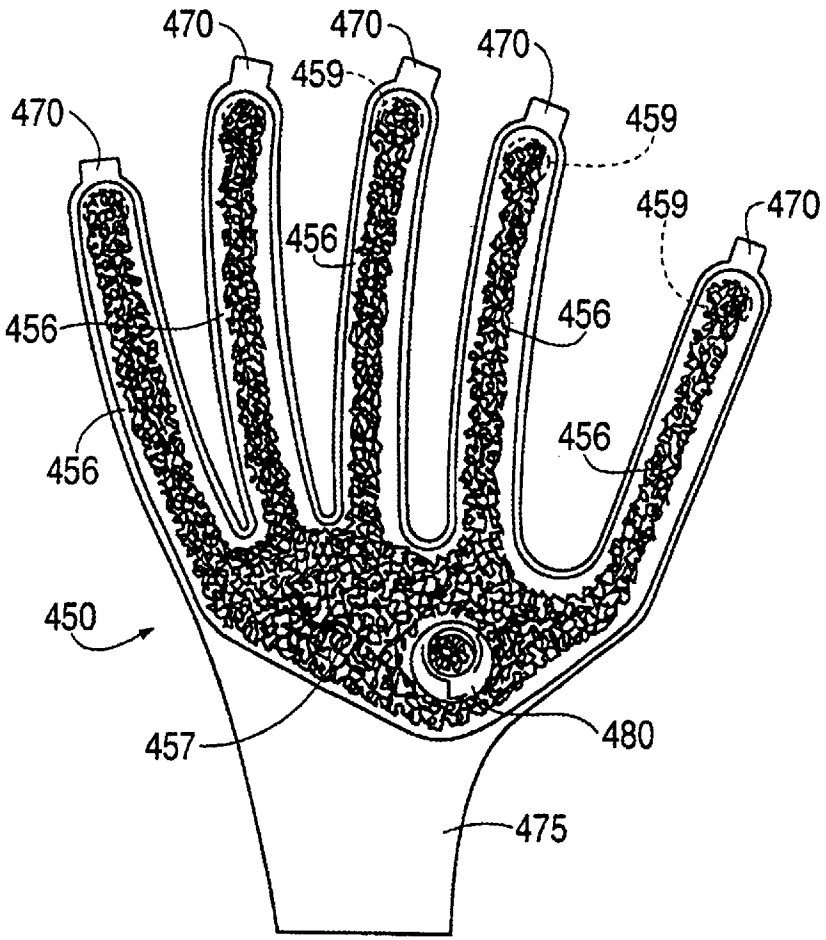
FIG. 8 illustrates another alternative embodiment of an air distribution device according to the present invention.

The embodiment of an air distribution device 450 illustrated in FIG. 8 is substantially similar to the air distribution device 350 and includes channeling members 456, air outlets 459, air chamber 457, and an air conduit 480 coupled to a membrane of the air distribution device 450. In the illustrated embodiment in FIG. 7 however, tabs, or securing elements 470, 475 are provided on the membranes of air distribution device 450 to be secured between the layers of the hand covering during assembly as will be described. For example, the tabs may be sewn separately to the cover or the hand receiving portion or may simply be sewn using the same seam used to couple the hand receiving portion and cover together.

Figure 12:
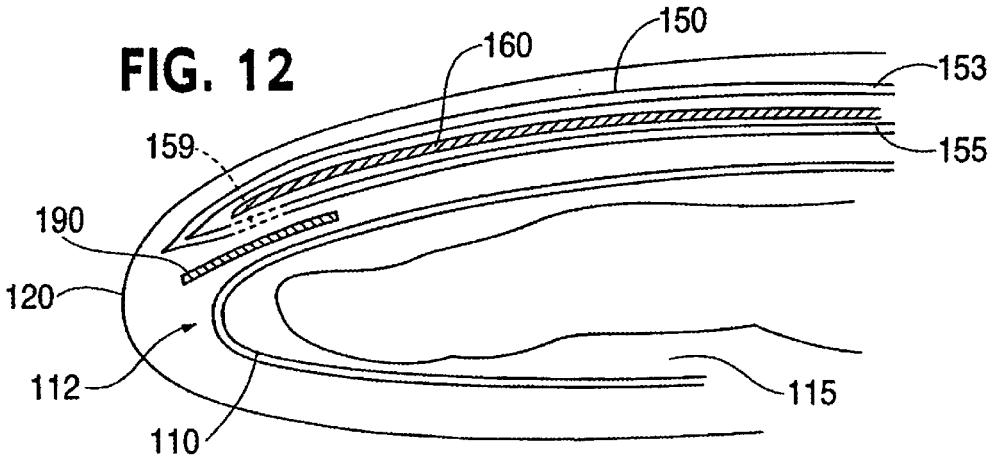
FIG. 12 illustrates a partial cross sectional view of another embodiment of the present invention taken along the line A—A of FIG. 3.
Figure 13:
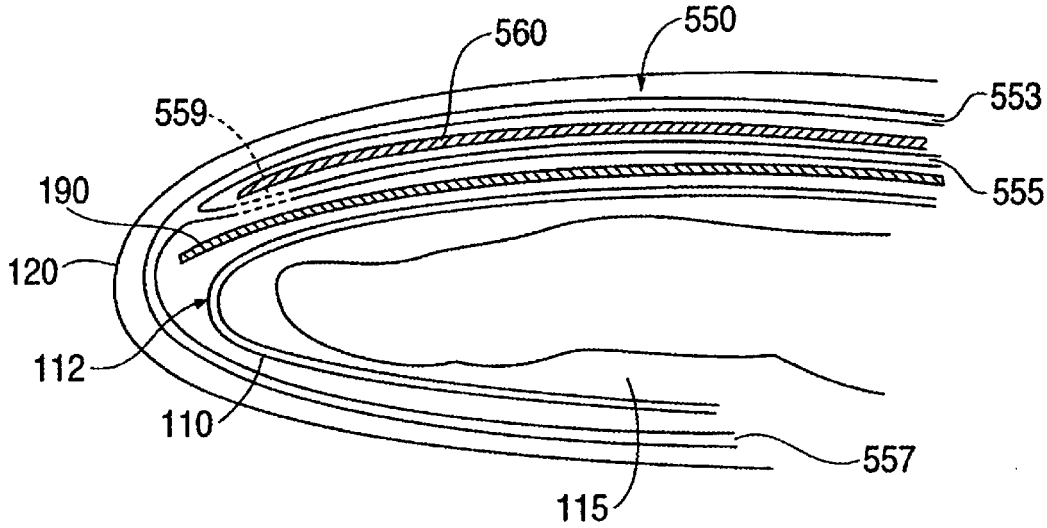
FIG. 13 illustrates a partial cross sectional view of yet another embodiment of the present invention taken along the line A—A of FIG. 3.
Figure 14:
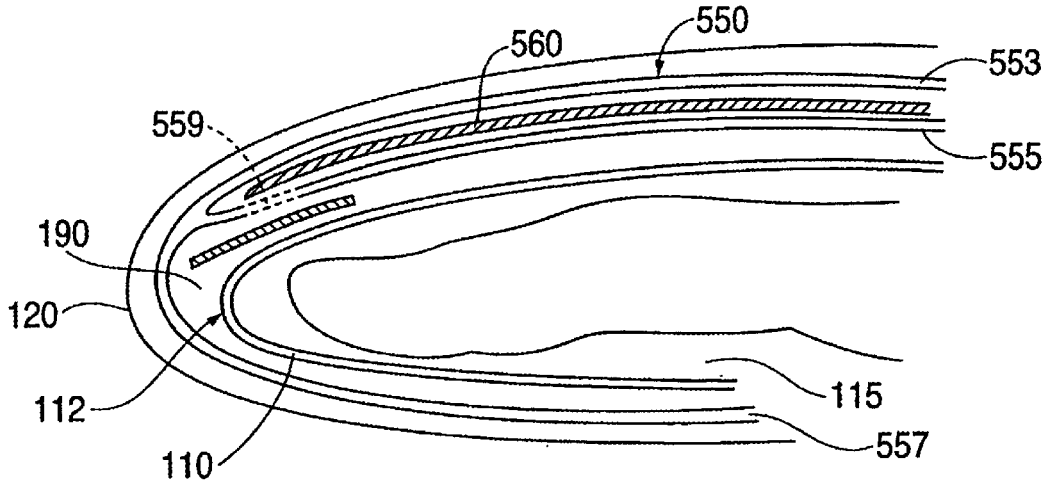
FIG. 14 illustrates a partial cross sectional view of a further embodiment of the present invention taken along the line A—A of FIG. 3.

Referring to FIGS. 12 through 14, a separate layer of fabric or foam 190, in addition to the fabric 160 disposed within the air distribution device between first and second membranes 153, 155, may be disposed between or adjacent to the air distribution device 150, 250, 350, 450, 550, 650, 750 and the hand receiving portion 110. The separate layer of fabric 190 can be a heat retaining fabric and/or can also act as a wicking material to prevent moisture from escaping through the outlet 159. The separate layer of fabric may be dimensioned such that it only covers the outlet 159 or can be dimensioned to extend the length of the channeling member or the entire air distribution device. It will be appreciated that the material that is disposed between the two membranes of the air distribution device may also have heat retaining qualities. Likewise, the hand receiving portion 110 may have such heat retaining qualities and may be manufactured from a heat retaining fabric to prevent the dissipation of heat from the hand covering. Examples of heat retaining fabrics are THERMALITE, commercially available from Dupont or THINSULATE™, commercially available from 3M Corporation.

Figure 9:
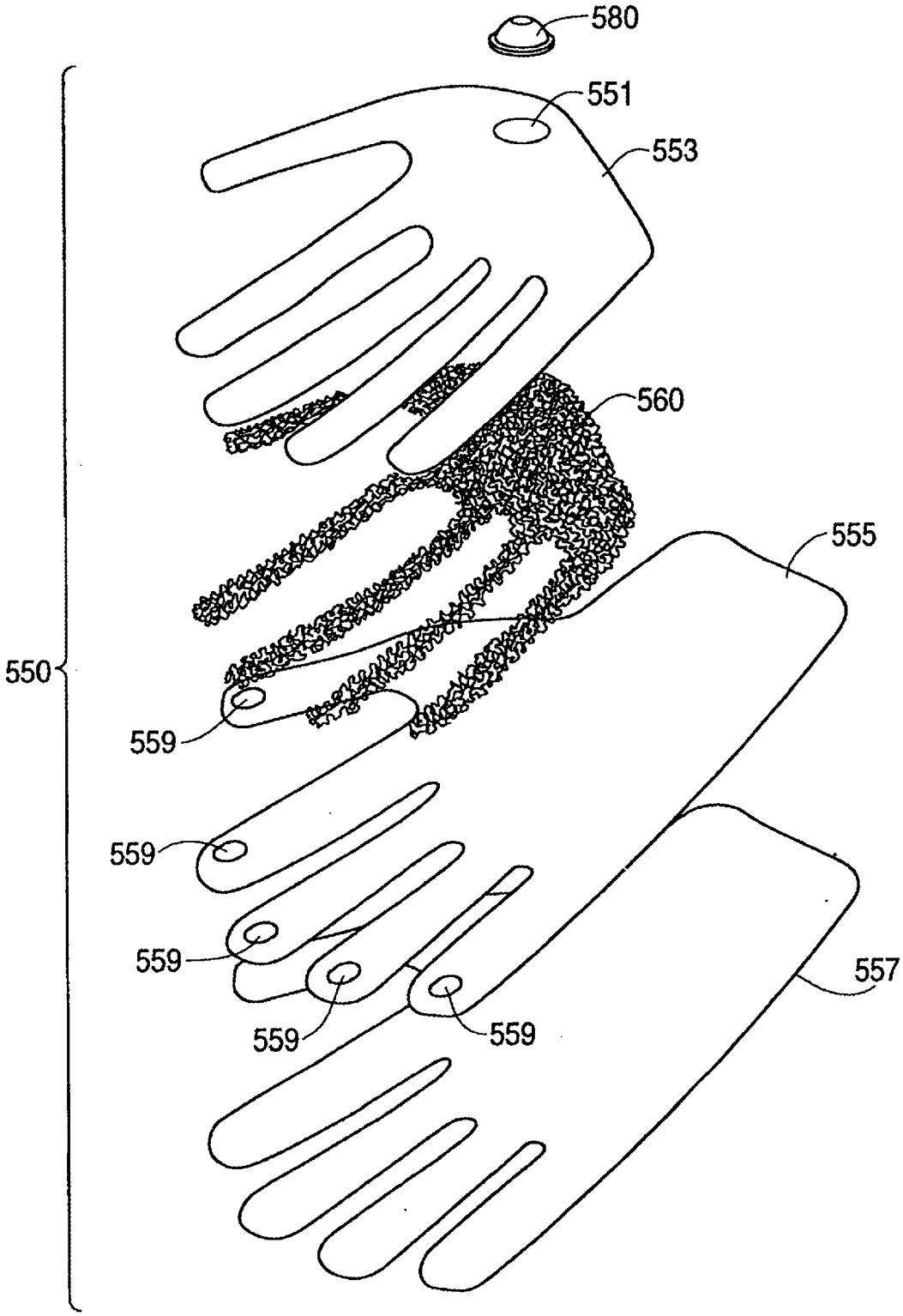
FIG. 9 illustrates an exploded view of an alternative embodiment of an air distribution device according to the present invention.
Figure 10:
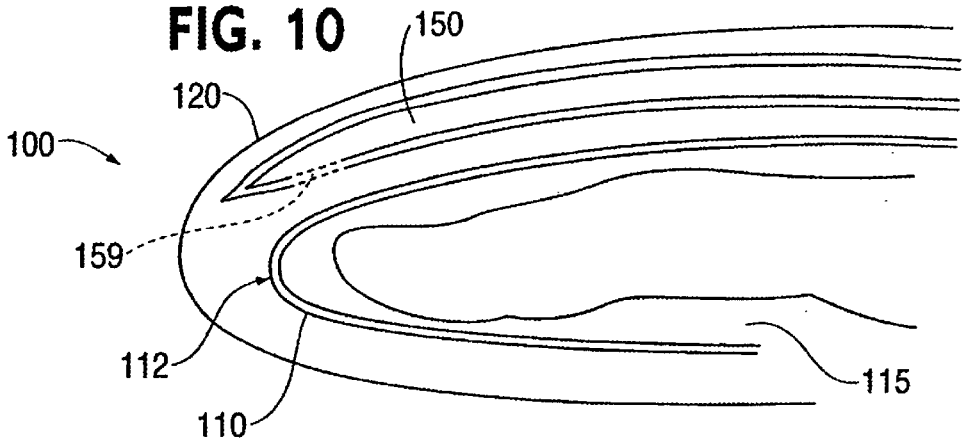
FIG. 10 illustrates a partial cross sectional view of an embodiment of the present invention taken along the line A—A of FIG. 3.
Figure 11:
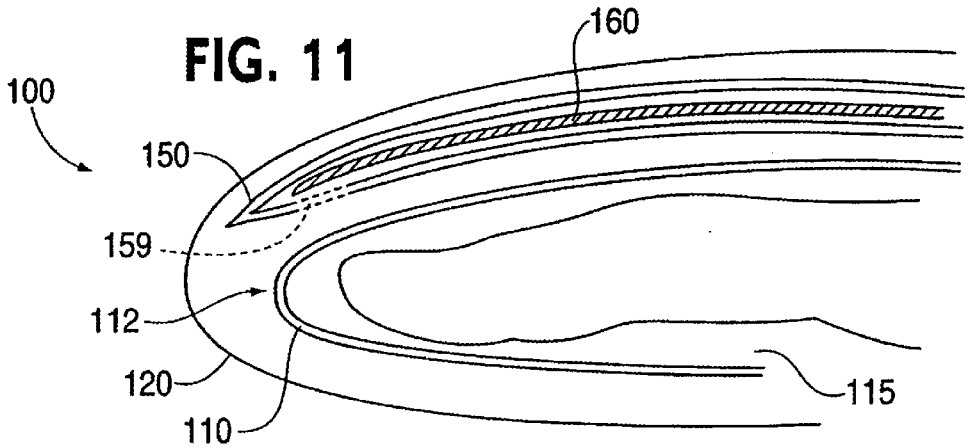
FIG. 11 illustrates a partial cross sectional view of a further embodiment of the present invention taken along the line A—A in FIG. 3.

As illustrated in FIGS. 9, 13 and 14, an alternative air distribution device 550 is illustrated that includes a first membrane 553 defining an inlet 551, a second membrane 555 and a third membrane 557. Alternatively, the membranes can be molded from a single piece of material rather than coupling separate pieces of material together. The air distribution device 550 is disposed between the cover 120 and the hand receiving portion 110. A layer of fabric 560, which is similar to fabric 190 as described above, may be disposed between the outlet 559 of the air distribution device 550 and the hand receiving portion 110. In the illustrated embodiment, the third membrane 557, along with the first and second membranes, 553, 555 act as a liquid barrier and/or a waterproof, breathable barrier that is configured to prevent liquid from entering the chamber 115 of hand receiving portion 110. An air conduit 580 is positioned in registry with the inlet 551.

Figure 15:
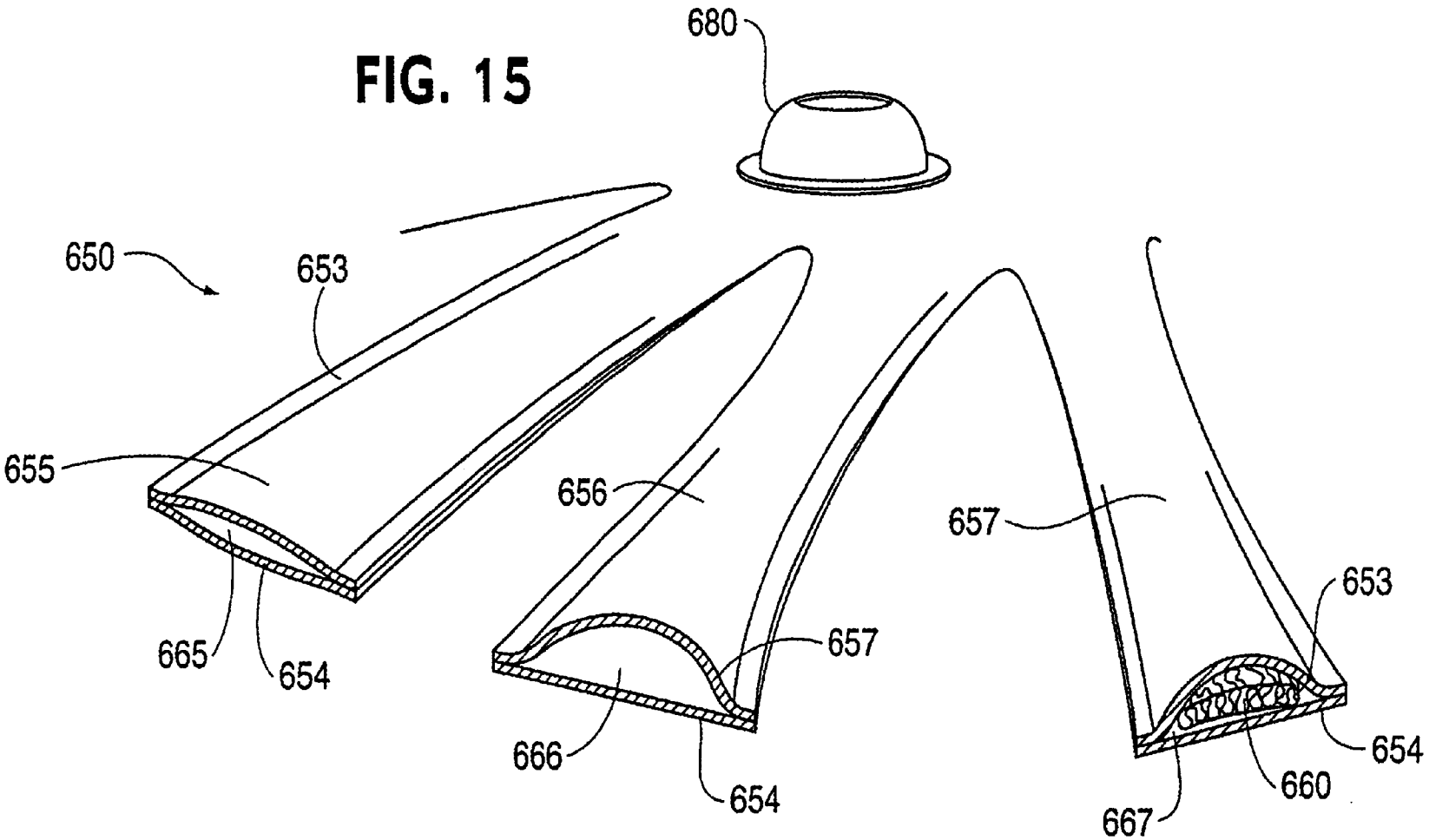
FIG. 15 illustrates a partial view of an air distribution device according to the present invention including embodiments of channeling members for use with the air distribution device of the present invention.

FIG. 15 illustrates a partial view of an embodiment of an air distribution device 650 that includes an air conduit 680 and channeling members 655, 656 and 657. Each of the channeling members 655, 656, 657 in the illustrated embodiment includes an outlet 665, 666, and 667, respectively that is defined at the end of the channeling member. Channeling member 657 includes a layer of material 660 between the first membrane 653 and the second membrane 654 as described above in detail with respect to air distribution device 350. Note that FIG. 15 shows alternative configurations for channeling members, only one of which may be included for any one particular embodiment.

The first and second membrane 653, 654 may be coupled together in a variety of configurations to form various outlets. For example, channeling member 655 illustrates an embodiment in which the first and second membranes are coupled together such that they are both arcuate in cross section, and define an opening or air passage 665, to inhibit the collapsing of the channeling member 655.

The first and second membrane 653, 654 that comprise channeling member 656 are configured such that the first membrane 653 is positioned in an arcuate fashion above the second membrane 654 which is taut in configuration such that the first membrane 653 does not collapse thereby closing an opening or air passage 666, inhibiting air flow through the channeling member 656.

Channeling member 657 includes a layer of material 660 disposed therein to prevent the first membrane 653 from collapsing onto the second membrane 654 thereby closing an opening or air passage 667, inhibiting the flow of air through the channeling member 657 as previously described. As will be appreciated, other configurations of the channeling members of the air distribution device that allow the passage of air, but resist the collapsing of the channeling member are contemplated by the present invention.

Figure 16:
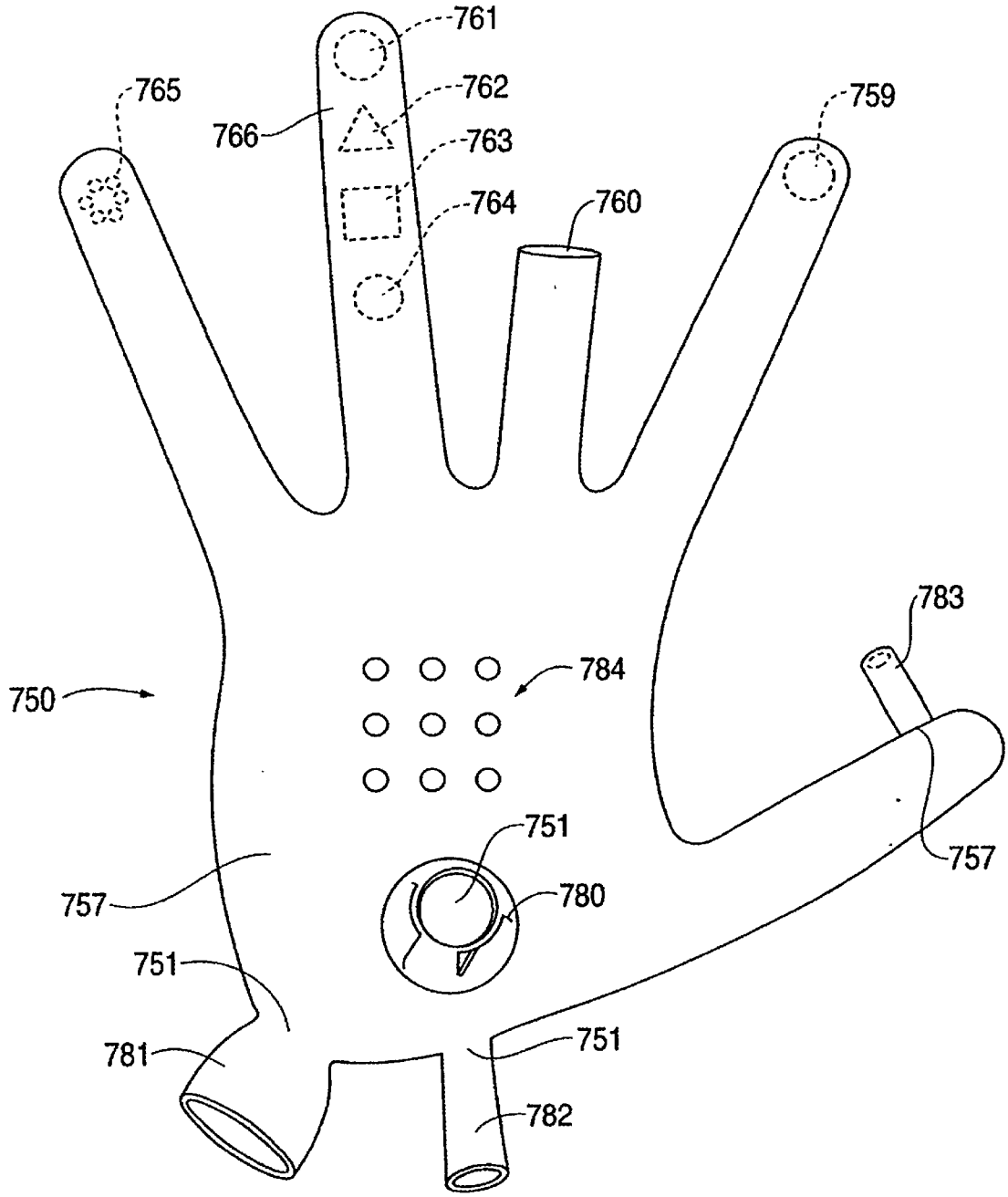
FIG. 16 illustrates an exemplary air distribution device according to the present invention including illustrations of embodiments of air inlets, and air outlets.

FIG. 16 illustrates an embodiment of an air distribution device 750 that depicts various inlets and outlets according to the present invention. Any one or all of the illustrated inlets and outlets may be included on the air distribution device 750. It is contemplated that one particular type and location of an inlet and one particular type and set of locations of outlets will be implemented for a given embodiment. Inlet 751 may be located adjacent any of the illustrated conduits 780, 781, 782, or 783. Additionally, quilting 784 may be included in the air chamber 757 to prevent the air chamber 757 from over-expanding when air is introduced.

Several alternative embodiments of outlets of the air distribution device are illustrated in FIG. 16. For example, outlet 765 may include openings defined on the second membrane of the air distribution device. The outlets may be various shapes and sizes and may be positioned along the length of a channeling member 766 of the air distribution device as illustrated by outlets 761, 762, 763, and 764.

Alternatively, the outlet may be a single opening 759 defined proximate the end of the second membrane as discussed above. The outlet may also be defined at the end of the channeling member as illustrated by outlet 760.

Figure 18:
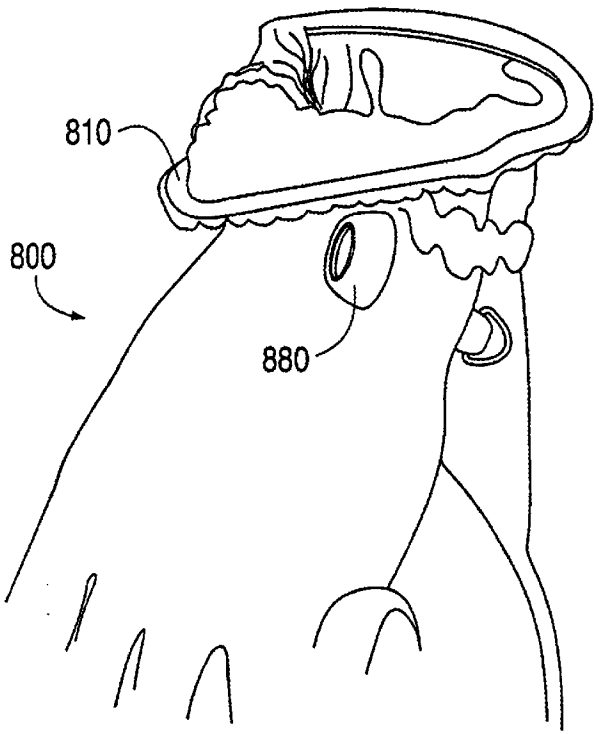
FIG. 18 illustrates a partial perspective view of the hand covering illustrated in FIG. 17 in a second configuration.
Figure 17:
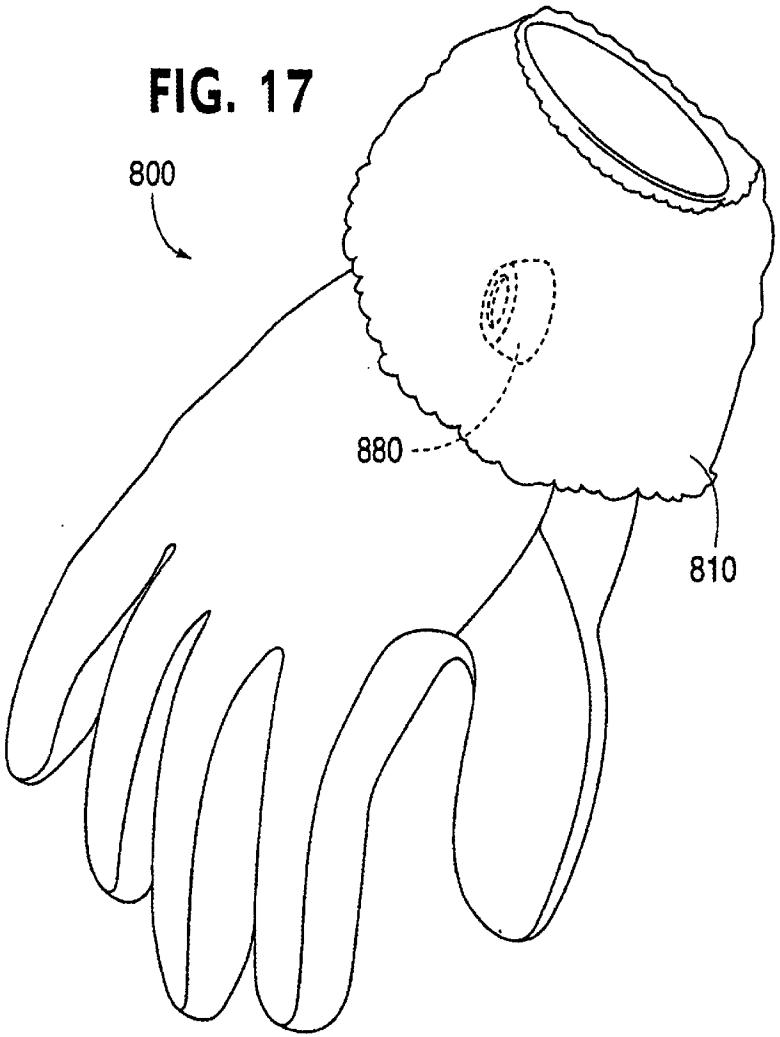
FIG. 17 illustrates an alternative embodiment of the hand covering according to the present invention in a first configuration.

FIGS. 17 and 18 illustrate an alternative embodiment of the hand covering 800 in which the conduit 880 is concealed by a cuff 810 that is folded over to shield the conduit. To provide access to the conduit 880, the cuff 810 is folded back as illustrated in FIG. 18.

Figures 19, 20, 21:
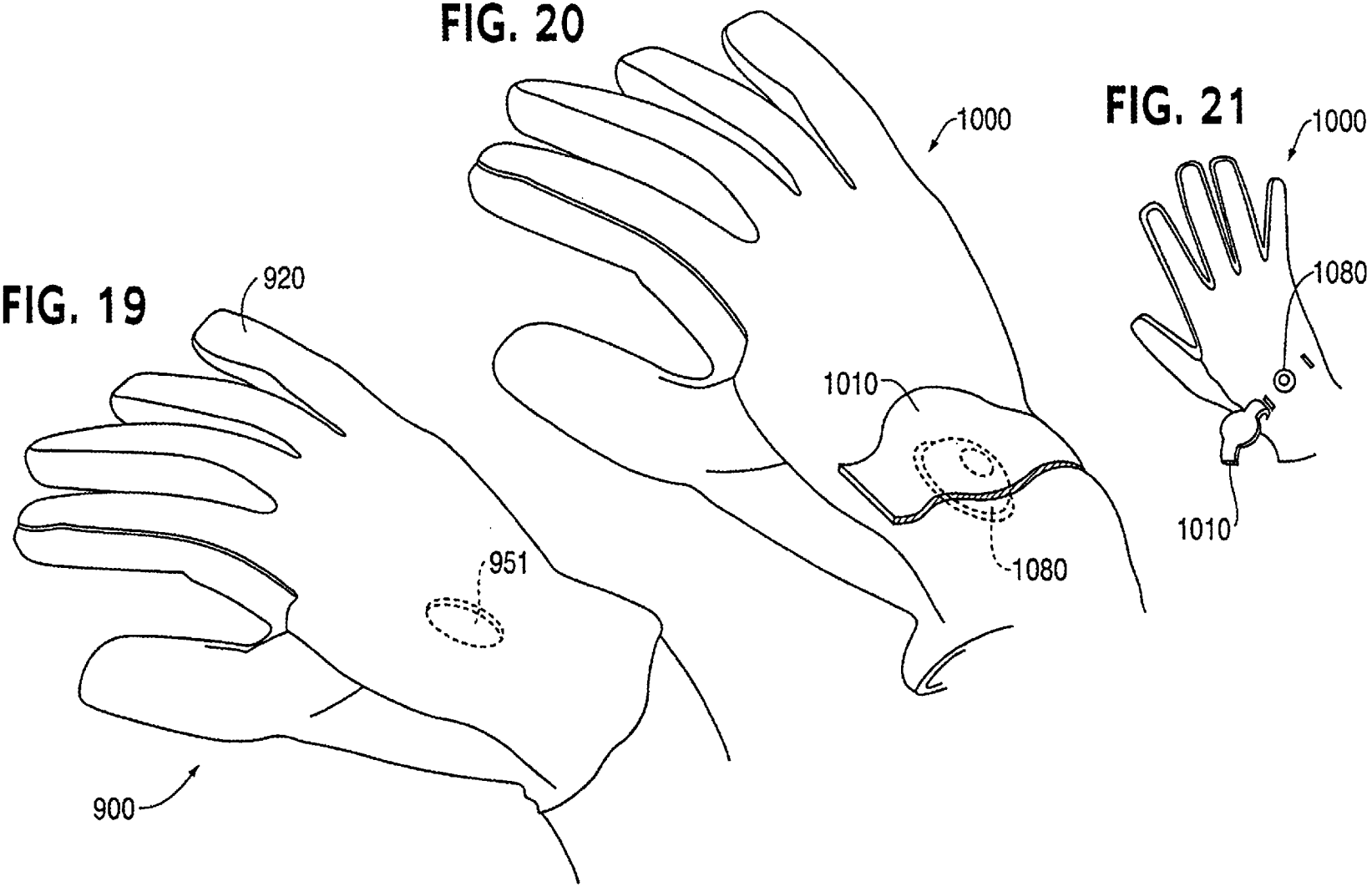
FIG. 19 illustrates another alternative embodiment of the hand covering according to the present invention.
FIG. 20 illustrates a further alternative embodiment of the hand covering according to the present invention in a first configuration.
FIG. 21 illustrates the hand covering illustrated in FIG. 20 in a second configuration.

FIG. 19 illustrates an embodiment of the hand covering 900 in which no air conduit or air intake is provided. Instead, air is introduced into the inlet 951 of the air distribution device through the cover 920. In such an embodiment, the cover may include an opening or may simply be permeable to air.

FIGS. 20 and 21 illustrate a further embodiment of a hand covering 1000 that includes a strap 1010 that is configured to cover air conduit 1080. By covering the air conduit 1080 debris and moisture are prevented from entering the air conduit. In use, air is introduced into the air conduit by removing the strap as illustrated in FIG. 21.

FIGS. 22 through 39 illustrate various embodiments of air conduits 1180, 1280, 1380, 1480, 1580, 1680, 1780, 1880, 1980, 2080, 2180, 2280, 2380, 2480, and 2580.

Figure 22:
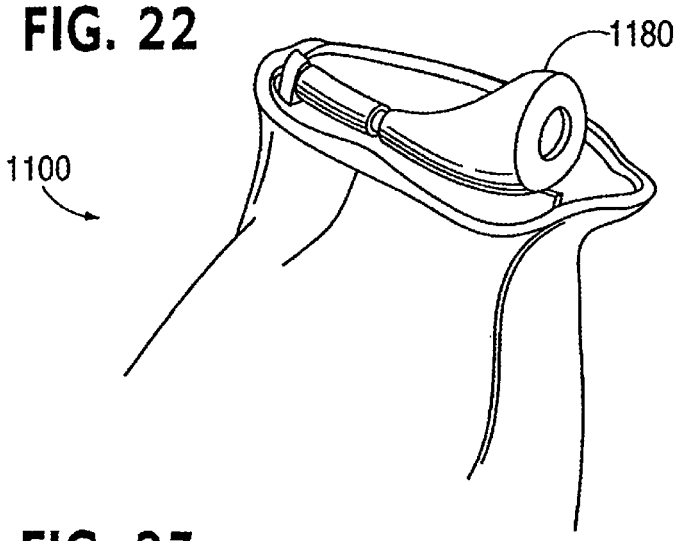
FIG. 22 illustrates an alternative embodiment of an air conduit of the present invention in a first configuration.
Figure 23:
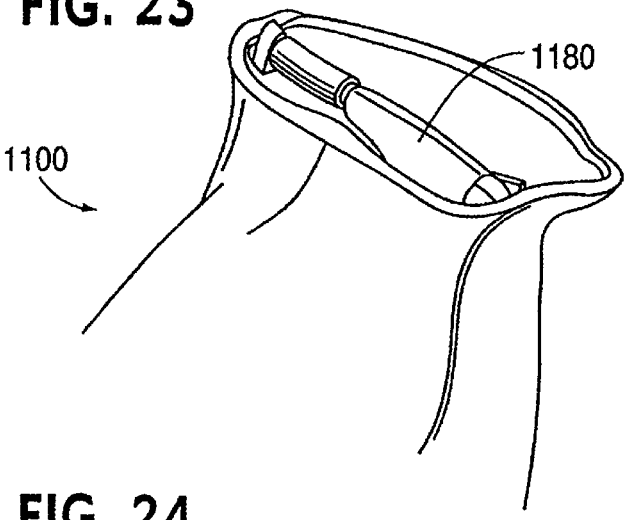
FIG. 23 illustrates the air conduit illustrated in FIG. 22 in a second configuration.

FIGS. 22 and 23 illustrate an embodiment of a hand covering 1100 having an air conduit 1180 that can be moved from a first position as illustrated in FIG. 22 to a second position illustrated in FIG. 23. When the air conduit 1180 is in its first position, it is accessible by a user. The air conduit can be moved to its second position to conceal it from view when not in use. When in the second position, the air conduit 1180 is also protected from debris and moisture.

Figure 24:
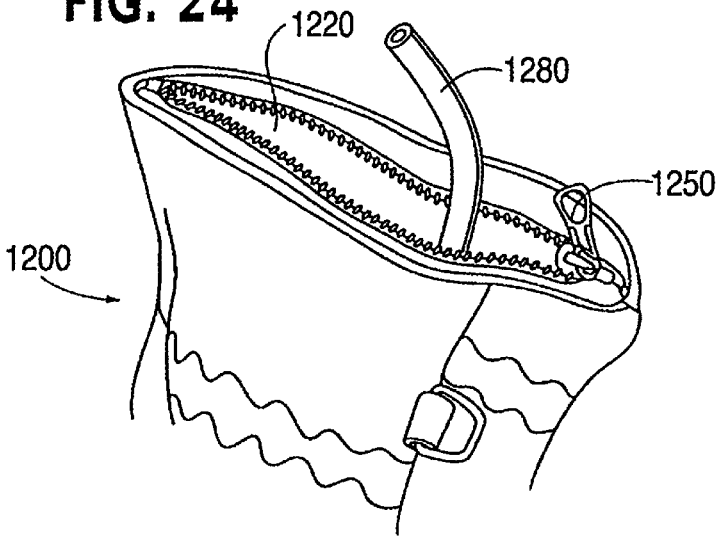
Figure 28:
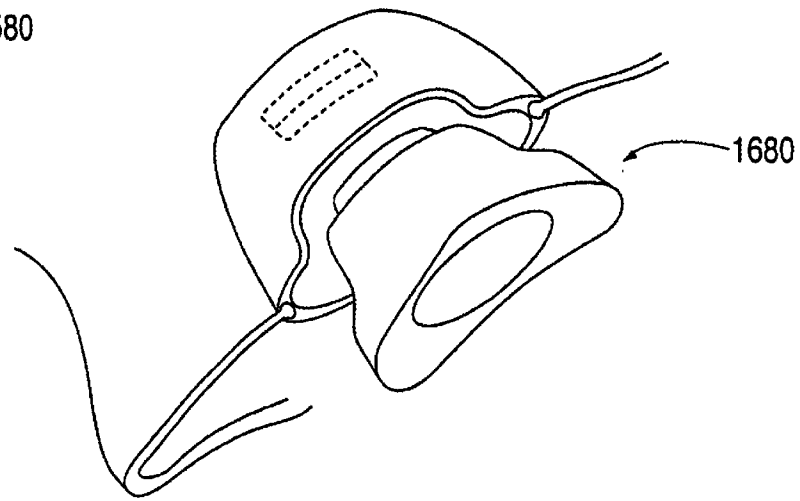
Figure 27:
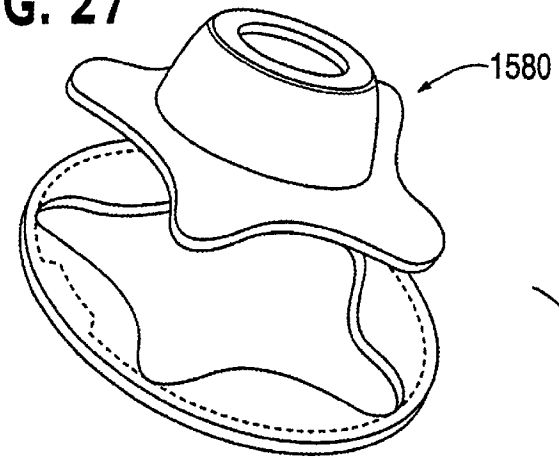
Figure 30:
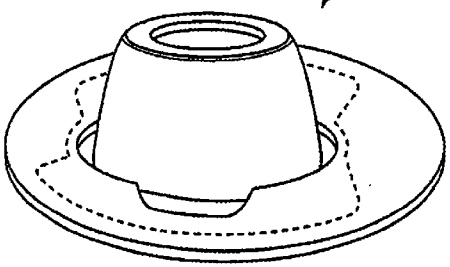
Figure 29:
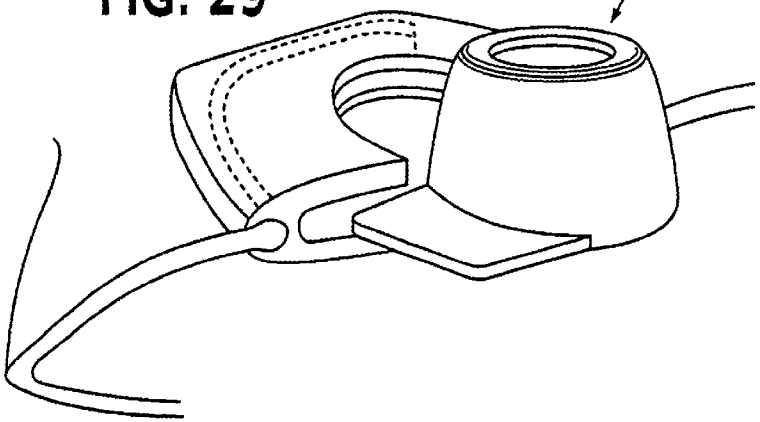

A further embodiment of an air conduit 1280 is illustrated in FIG. 24 in which the air conduit 1280 can be concealed within the hand covering 1200 in an opening 1220. The opening can be secured in a closed position by a fastener 1250 such as a zipper.

FIG. 25 illustrates an alternative embodiment of an air conduit 1480 that also includes a removable screen 1485. The screen 1485 prevents debris from entering the air distribution device 1450, and also prevents moisture from entering the device. The screen 1485 can be removed and cleaned and/or replaced. In an alternative embodiment, a wicking material 1487 is removably disposed with air conduit 1480.

FIGS. 26 through 30 illustrate embodiments of air conduits 1380, 1580, 1680, 1780, 1880 that can be removed from and cleaned and/or replaced into a hand covering such as hand covering 1300 illustrated in FIG. 26.

Figure 32:
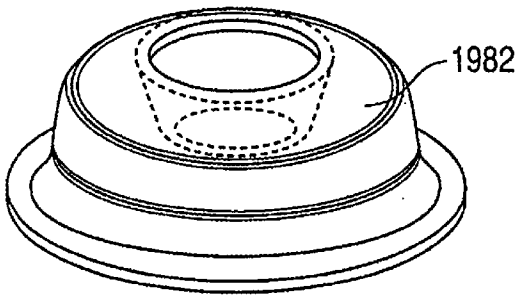
Figure 31:
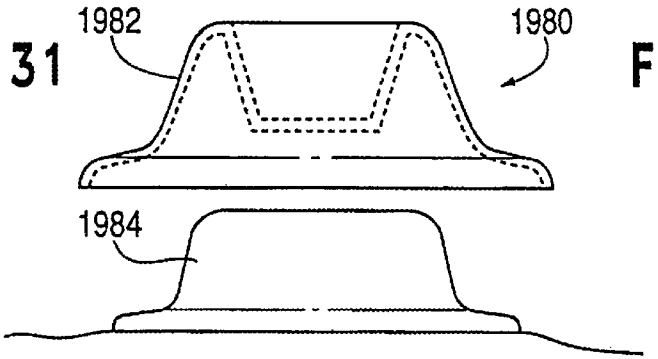

FIGS. 31 and 32 illustrate an embodiment of an air conduit 1980 that includes a removable cover 1982. The removable cover 1982 is coupled to a base 1984 for example by friction fit or snap fit. The removal cover 1982 can be removed for cleaning and/or replacement.

Figure 33:
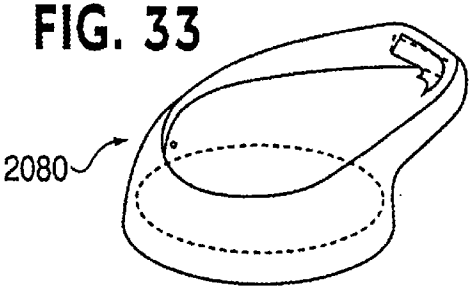
Figure 35:
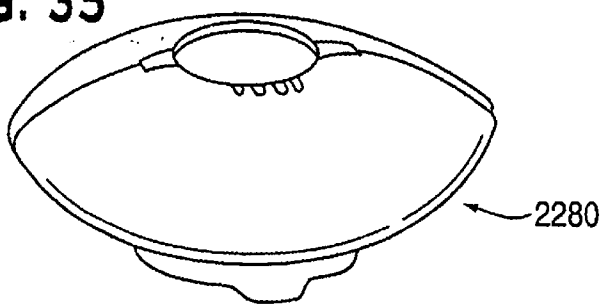
Figure 34:
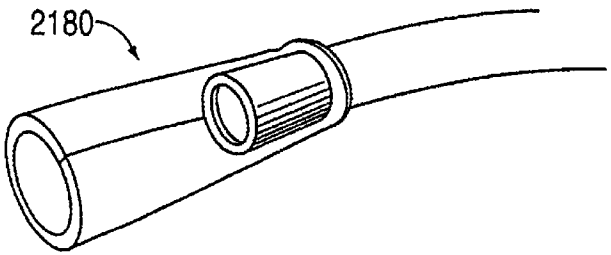

FIGS. 33 through 35 illustrate alternative shapes for air conduits 2080, 2180, 2280.

Figure 38:
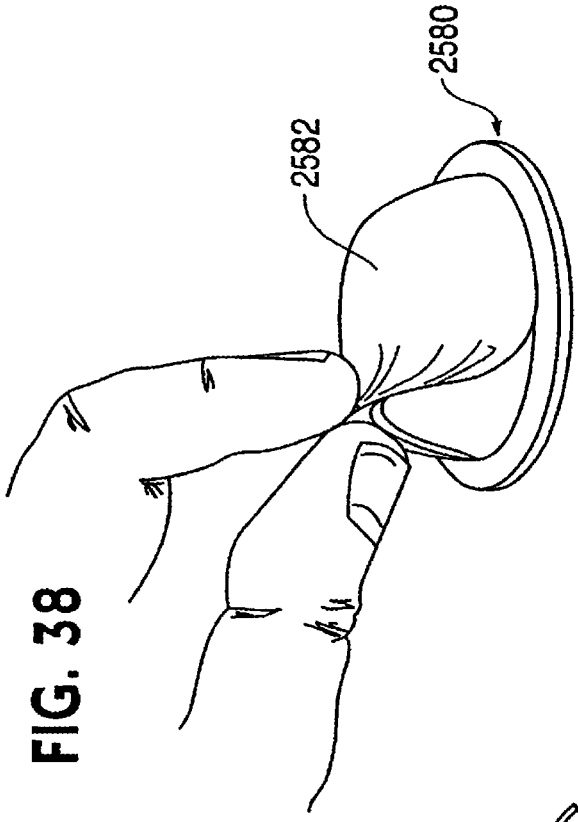
Figure 39:
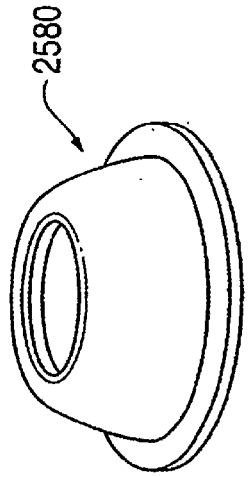
Figure 37:
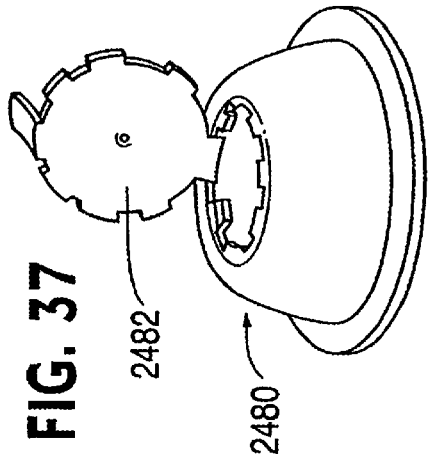
Figure 36:
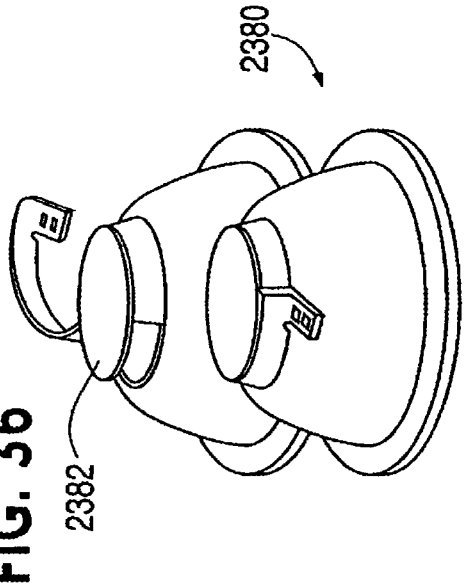

FIGS. 36 through 39 illustrate embodiments of air conduits that include protective covers that are intended to be maintained in place until purchased by a user and then removed and discarded. The covers 2382, 2482 and 2582 are intended to be sealed in place for sanitary or prophylactic purposes. FIG. 39 illustrates the air conduit 2580 that is illustrated in FIG. 38 with the cover 2582 removed.

Figure 40:
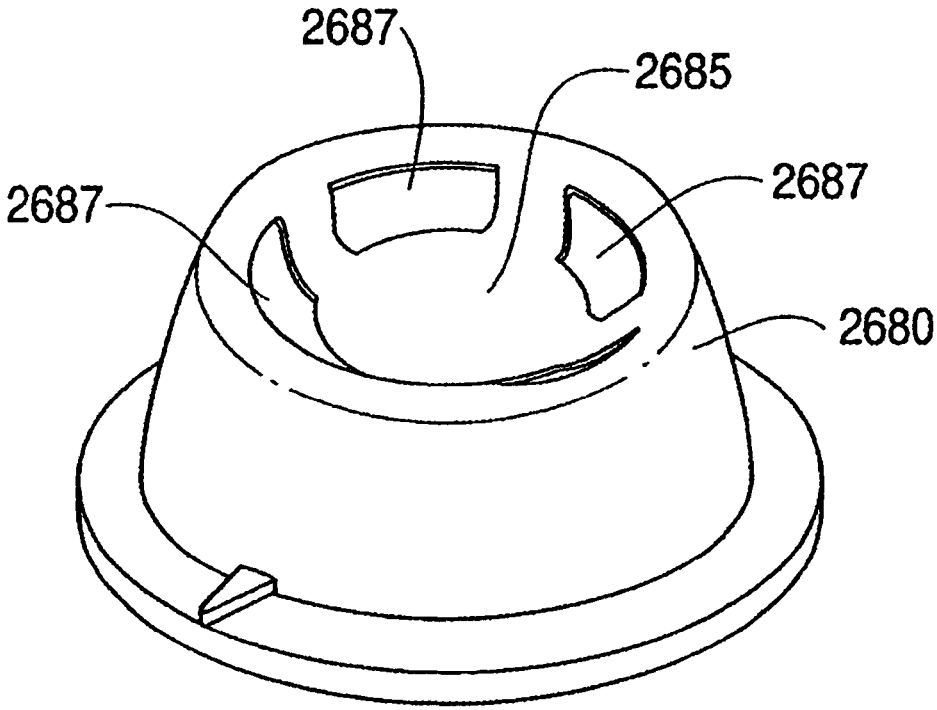

FIG. 40 illustrates an embodiment of an air conduit 2680 having an insert 2685 that allows air to pass through via openings 2687 while preventing some debris from entering the air conduit. The insert 2685 also provides and aesthetically pleasing appearance.

Any of the alternative air conduits described with respect to FIGS. 22 through 40 can be utilized with any of the embodiments of the air distribution device and hand covering described herein. Additionally, the hand covering and air distribution device can be configured to accommodate a variety of interchangeable air conduits.

Figure 42:
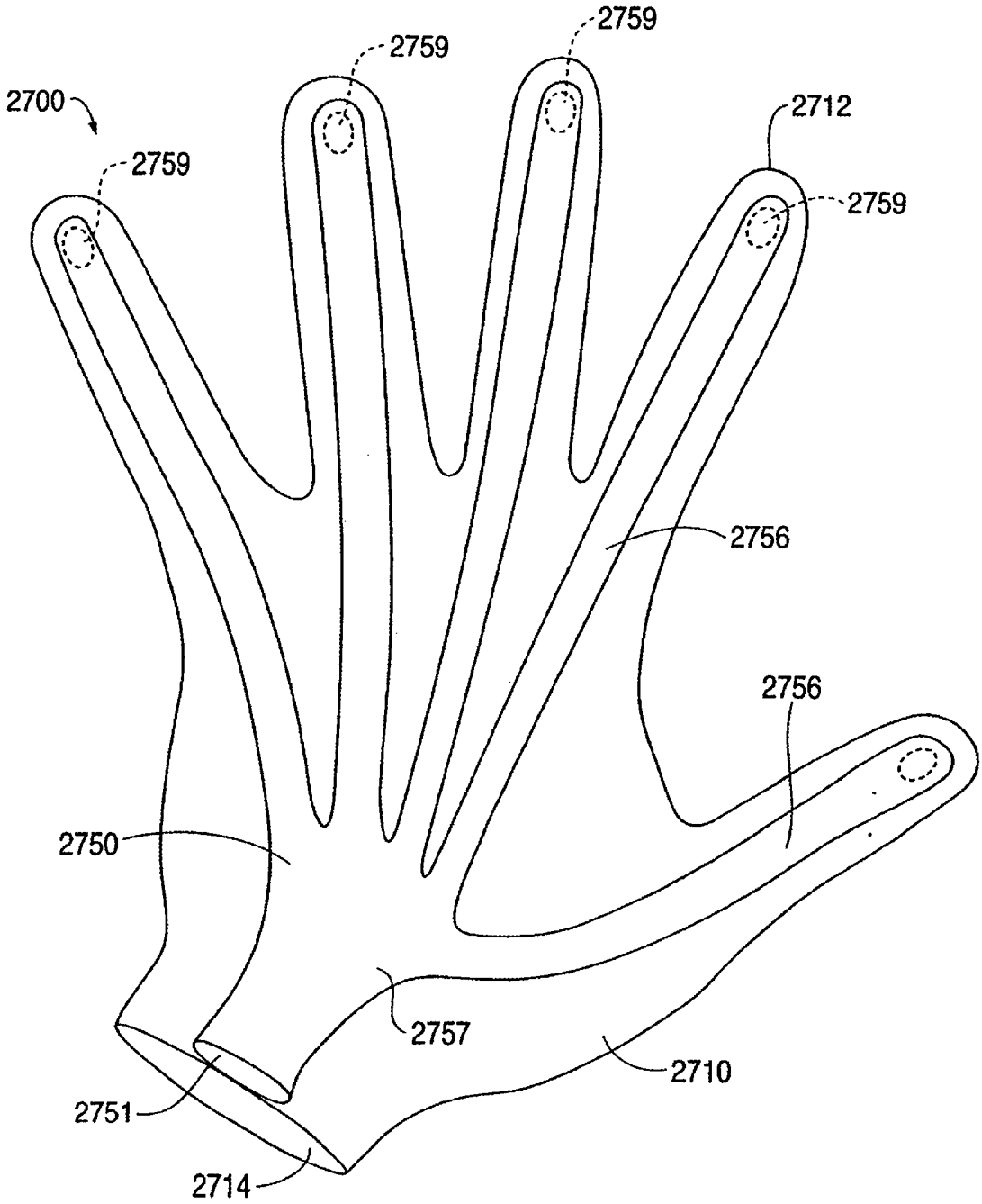
FIG. 42 illustrates an alternative embodiment of the hand covering according to the present invention.

FIG. 42 illustrates an alternative embodiment of a hand covering 2700 according to the present invention. The illustrated embodiment can be used alone, or as a liner that can be inserted into, for example, a glove, mitten, or similar article. In this manner, the air distribution device of the present invention can be used inside of existing hand coverings.

The hand covering 2700 includes a hand receiving portion 2710 having a first end 2712 and a second end 2714. An air distribution device 2750 is coupled to the hand receiving portion 2710 and includes an inlet 2751 and outlets 2759. An air chamber 2757 is located adjacent the inlet 2751. The air distribution device includes air channels 2756 that extend between the air chamber 2757 and the outlets 2759.

The air distribution device 2750 may be constructed from two membranes as described above or, alternatively, may include a single membrane coupled adjacent to one side of the hand receiving portion 2710.

In use, when the hand covering 2700 is used as a liner to be inserted into a glove or a mitten, the first end 2712 of the hand covering 2750 can be positioned adjacent to the closed end of the glove or mitten and the second end 2714 can be positioned adjacent to the open end of the glove or mitten.

Figure 43:
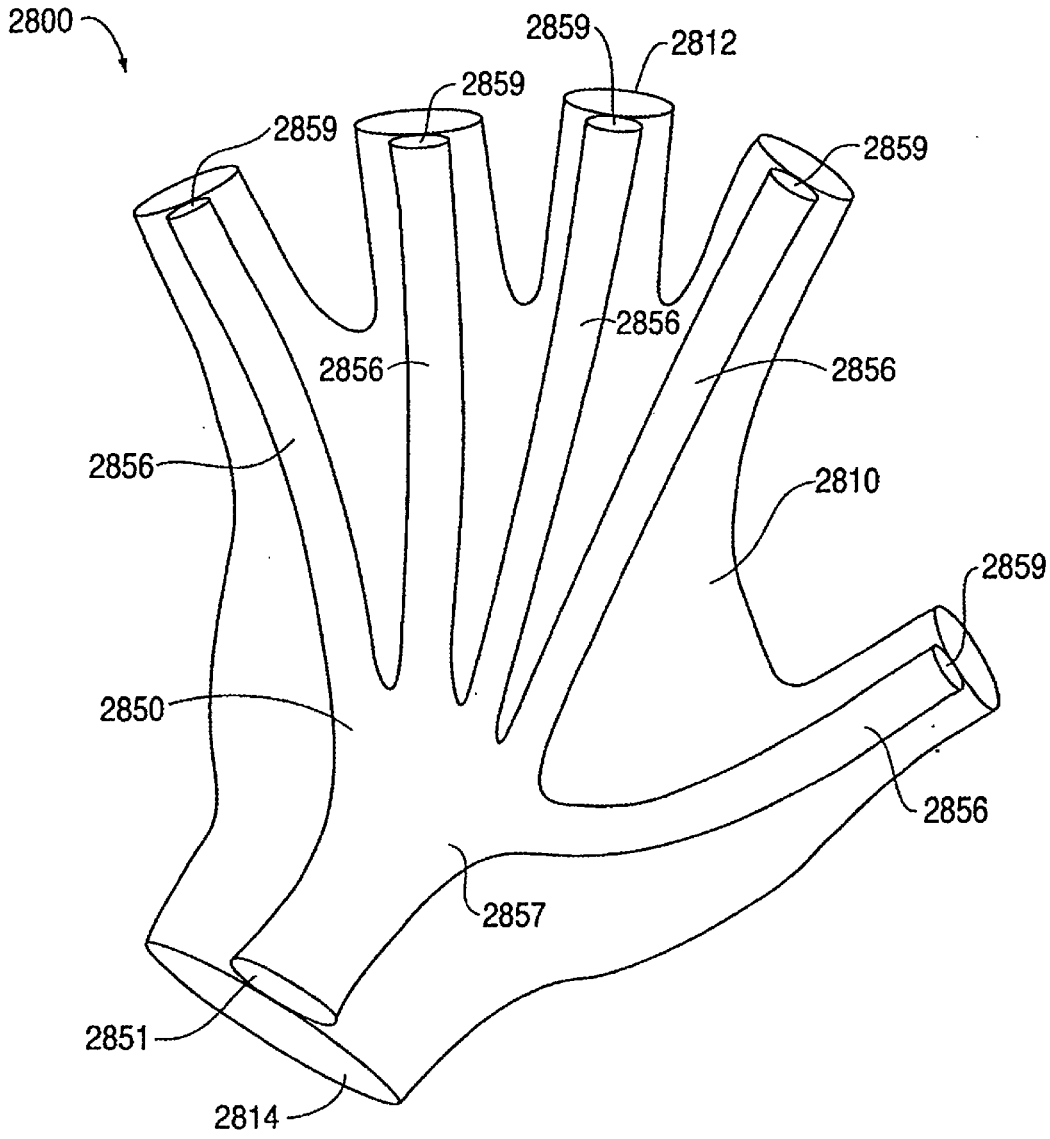
FIG. 43 illustrates a further alternative embodiment of the hand covering according to the present invention.

FIG. 43 illustrates a further embodiment of the invention in which hand covering 2800 includes a hand receiving portion 2810 having a first end 2812 and a second end 2814. The hand receiving portion 2810 defines a first opening at the second end 2814 for receiving a user's hand. The hand receiving portion 2810 also defines multiple openings at the first end 2812 configured to receive the fingers of a user therethrough.

An air distribution device 2850 is coupled to the hand receiving portion 2810 and includes an inlet 2851, and multiple outlets 2859 spaced apart from the inlet 2851. The air distribution device 2851 is configured to communicate air from the inlet 2851 to the multiple outlets 2859 through multiple air channels 2856 such that the temperature and pressure of the air at the inlet 2851 are substantially the same as the temperature and pressure at the outlets 2859. Alternatively, the pressure of the air at the inlet 2851 may be different than the pressure of the air at the multiple outlets 2859. The air distribution device 2850 can include an air chamber 2857 located between the inlet 2851 and the air channels 2856.

The inlet 2851 of the air distribution device 2850 is substantially coplanar with the opening defined at the second end 2814 of the hand receiving portion 2810. The outlets 2850 are each substantially coplanar with an opening defined at the first end 2812 of the hand receiving portion 2810. In this manner, air that is distributed through the air distribution device 2850 is exhausted to the portion of the user's hand that protrudes through the openings defined in the first end 2812 of the hand receiving portion 2810. Because the air distribution device 2850 does not dissipate a substantial amount of heat along the length of the air passages as previously described, the amount heat exhausted at the outlet is maximized.

The air distribution device may include two membranes, as described above, that define the inlet 2851, the outlets 2859 and the air passages 2856. There may be a material disposed between the two membranes that has the moisture reducing and/or heat retaining qualities described above.

In alternative embodiments, the air distribution device may include a single membrane coupled adjacent to one side of the hand receiving portion 2810. In such an embodiment, the membrane and the hand receiving portion together define the inlet 2851, the outlets 2859 and the air passages 2856. There may be material disposed between the membrane and the hand receiving portion as previously described.

In use, the hand covering 2800 may be used as a liner that is inserted into another hand covering such as a glove or a mitten.

Figure 44:
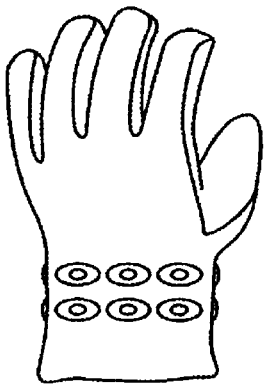
FIGS. 44 through 145 illustrate alternative embodiments of the hand covering according to the present invention.
Figure 145:
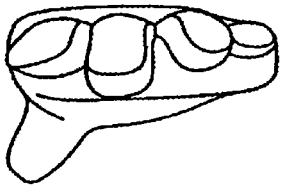

FIGS. 44 through 145 illustrate embodiments of the hand covering illustrating alternative embodiments and locations of the air conduit according to the present invention. The illustrated embodiments include air conduits of varying shape, height (i.e., distance from the surface of the glove to the inlet of the air conduit), position and relative orientation.

Figure 45:
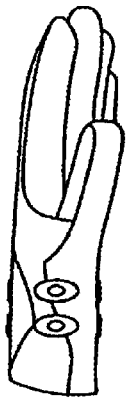
Figure 46:
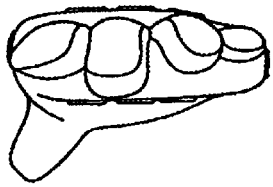
Figure 47:
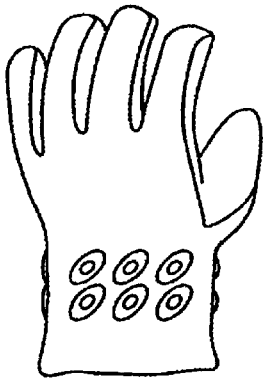
Figure 48:
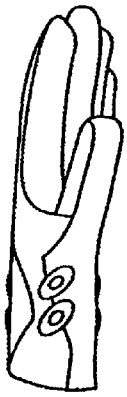
Figure 49:
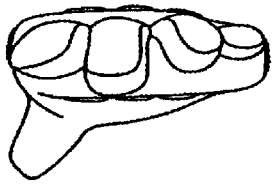
Figure 50:
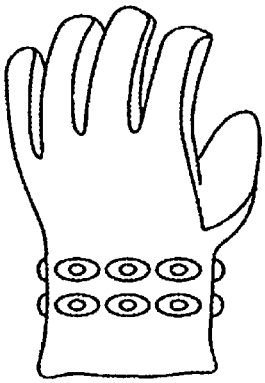
Figure 51:
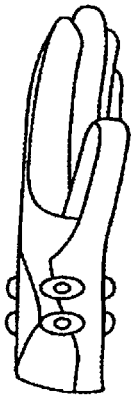
Figure 52:
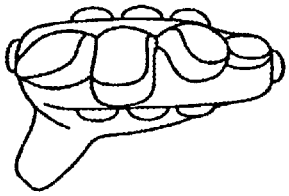
Figure 53:
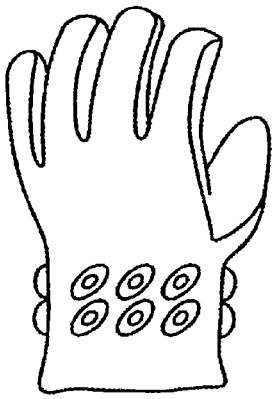
Figure 54:
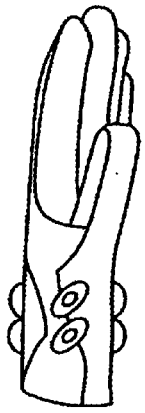
Figure 55:
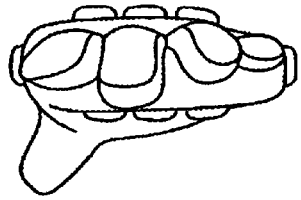
Figure 56:
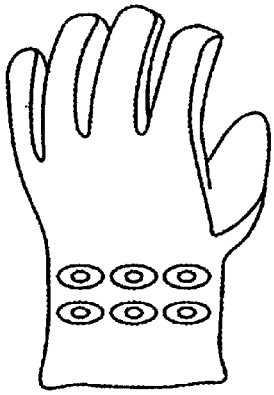
Figure 57:
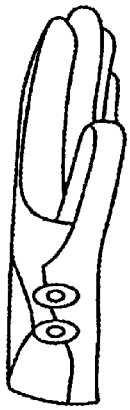
Figure 58:
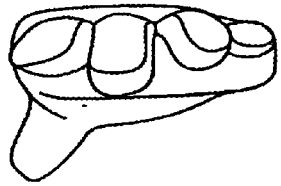
Figure 59:
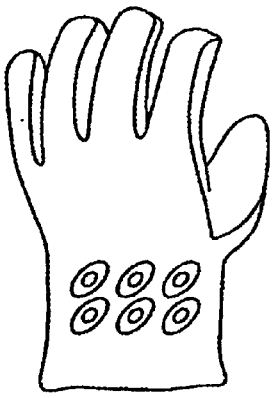
Figure 60:
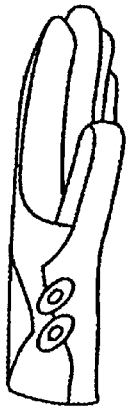
Figure 61:
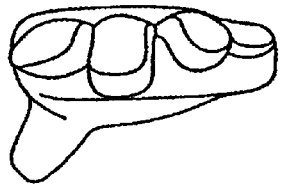
Figure 62:
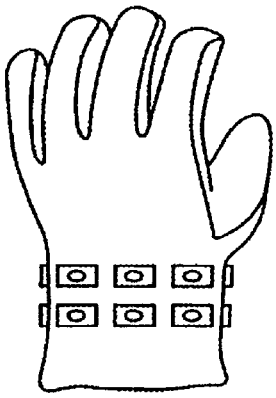
Figure 63:
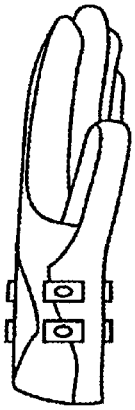
Figure 64:
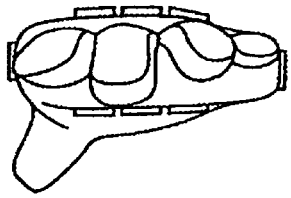
Figure 65:
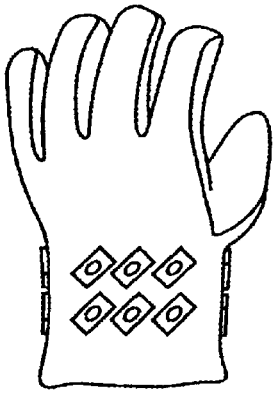
Figure 66:
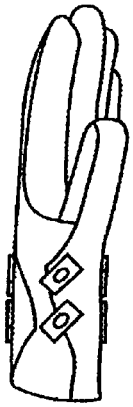
Figure 67:
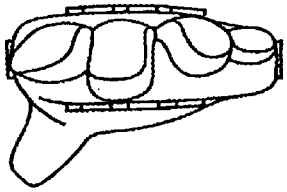
Figure 68:
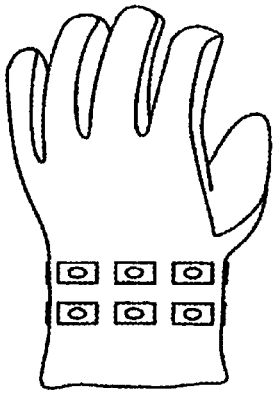
Figure 69:
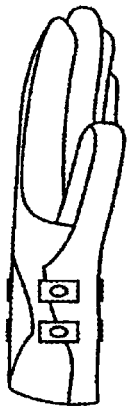
Figure 70:
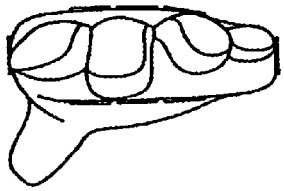
Figure 71:
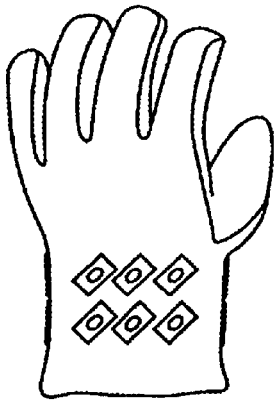
Figure 72:
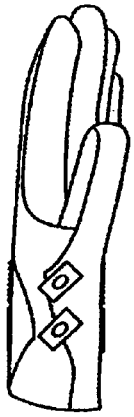
Figure 73:
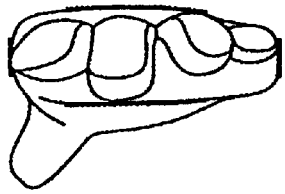
Figure 74:
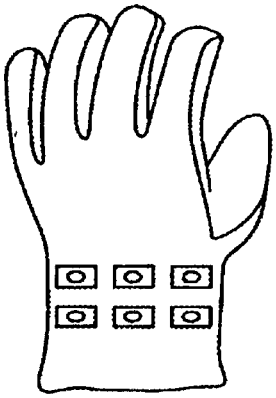
Figure 75:
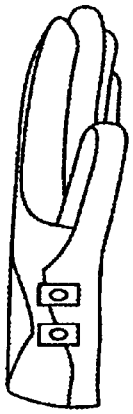
Figure 76:
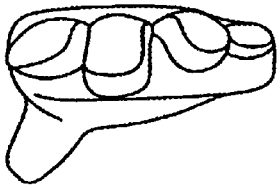
Figure 77:
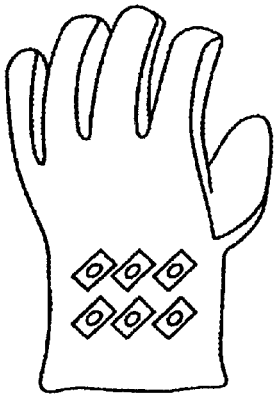
Figure 78:
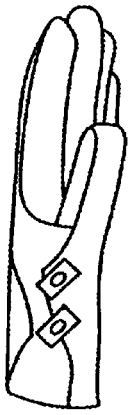
Figure 79:
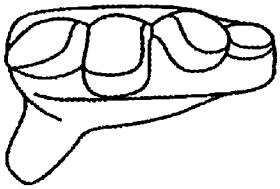
Figure 80:
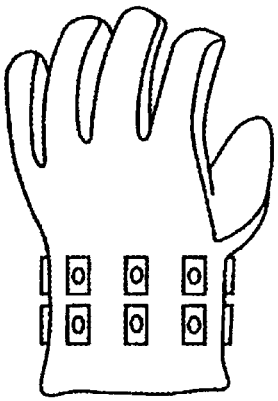
Figure 81:
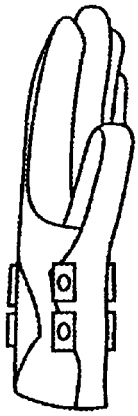
Figure 82:
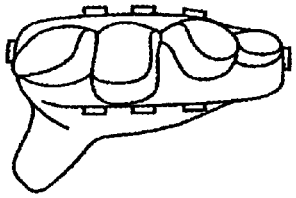
Figure 83:
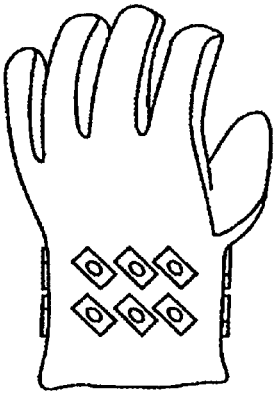
Figure 84:
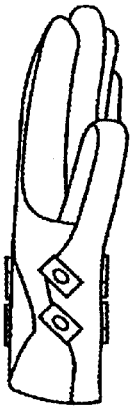
Figure 85:
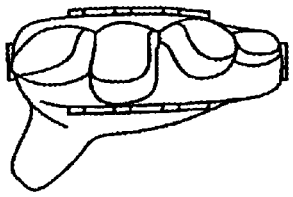
Figure 86:
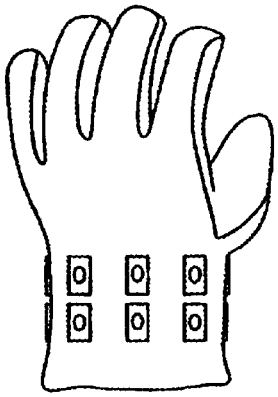
Figure 87:
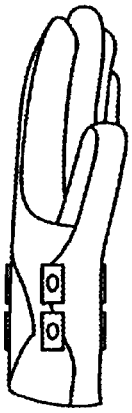
Figure 88:
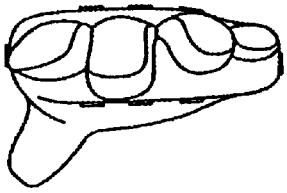
Figure 89:
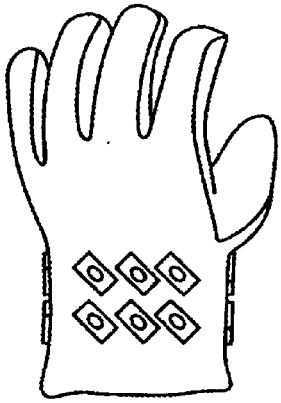
Figure 90:
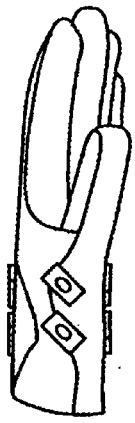
Figure 91:
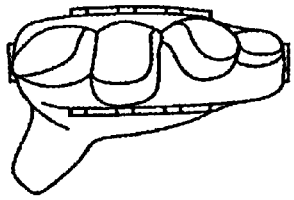
Figure 92:
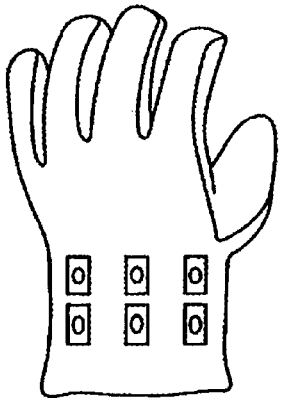
Figure 93:
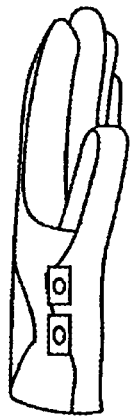
Figure 94:
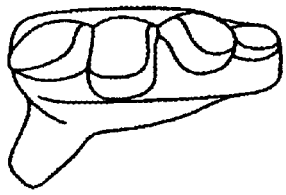
Figure 95:
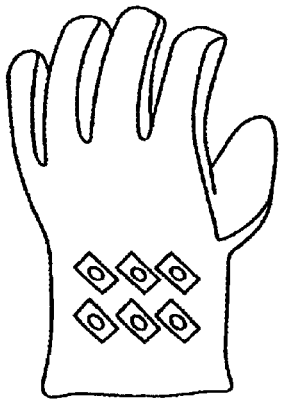
Figure 96:
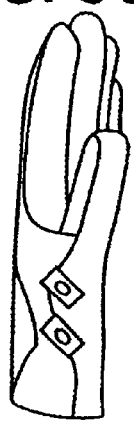
Figure 97:
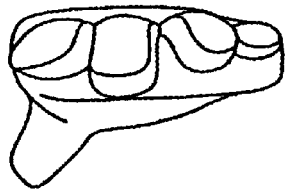
Figures 98, 99, 100, 101, 102, 103, 104, 105, 106, 107, 108, 109:
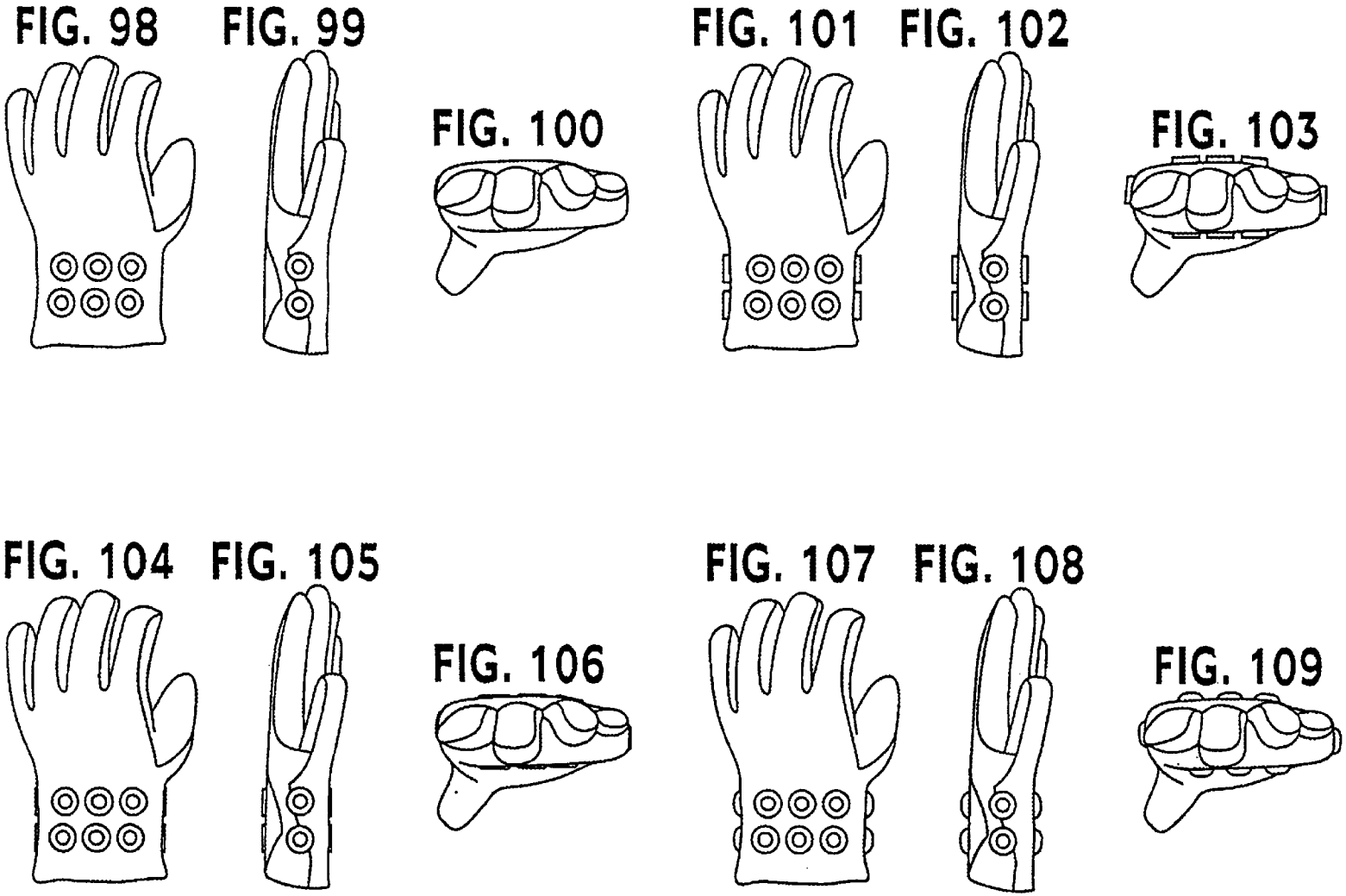
Figure 110:
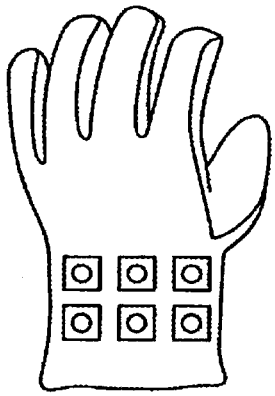
Figure 111:
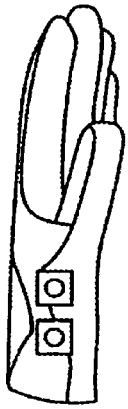
Figure 112:
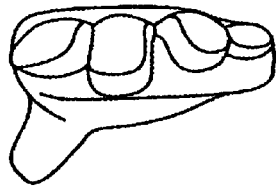
Figure 113:
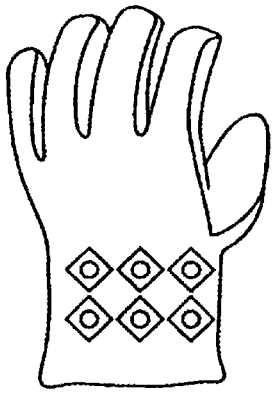
Figure 114:
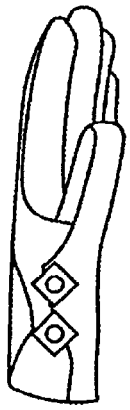
Figure 115:
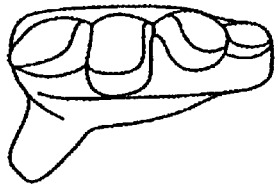
Figure 116:
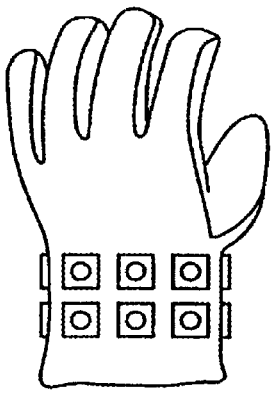
Figure 117:
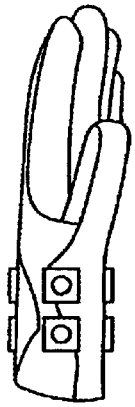
Figure 118:
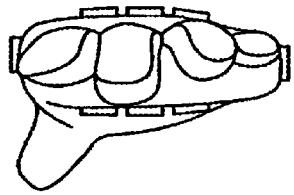
Figure 119:
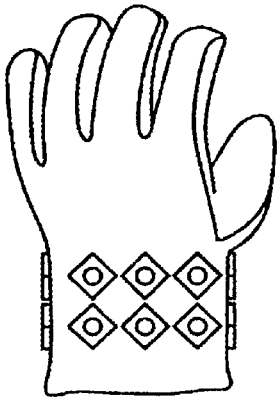
Figure 120:
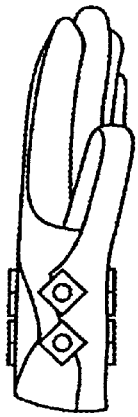
Figure 121:
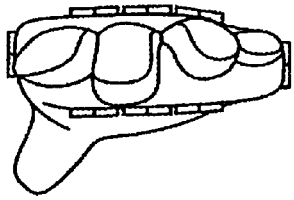
Figure 122:
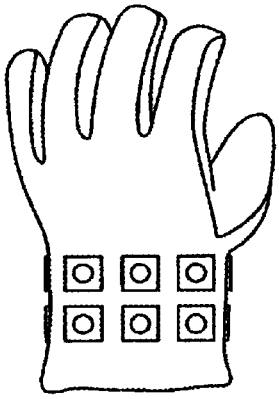
Figure 123:
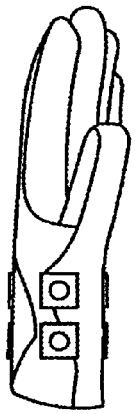
Figure 124:
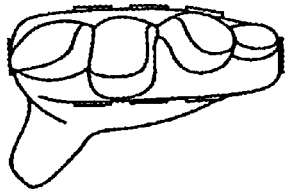
Figure 125:
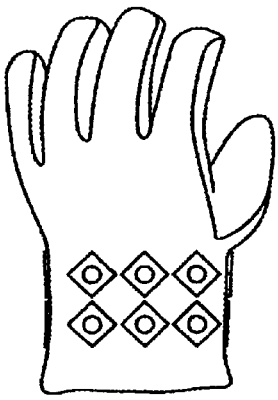
Figure 126:
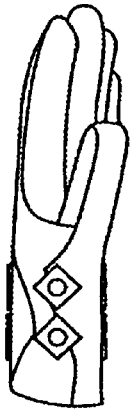
Figure 127:
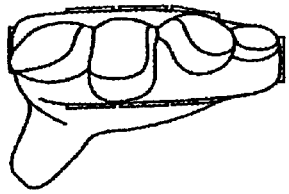
Figure 128:
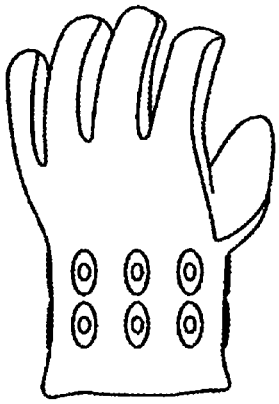
Figure 129:
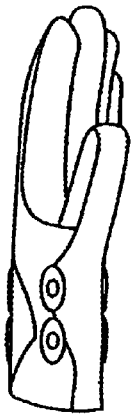
Figure 130:
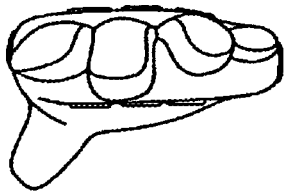
Figure 131:
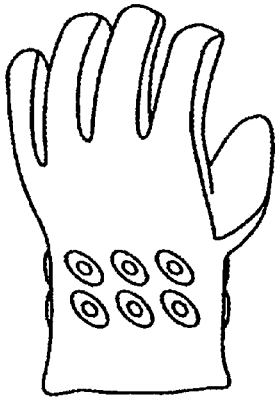
Figure 132:
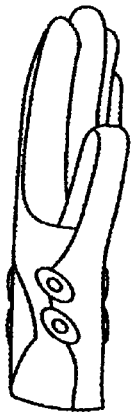
Figure 133:
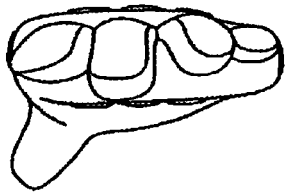
Figure 134:
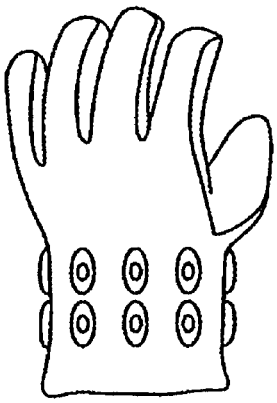
Figure 135:
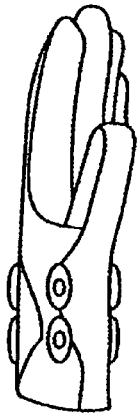
Figure 136:
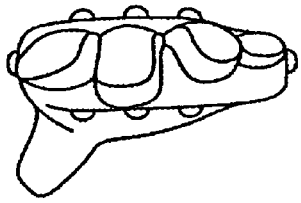
Figure 137:
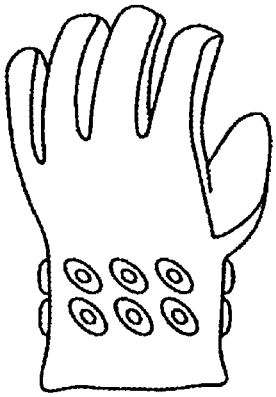
Figure 138:
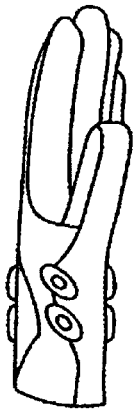
Figure 139:
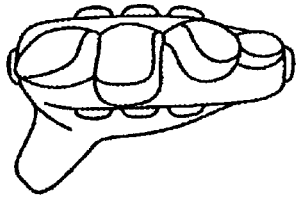
Figure 140:
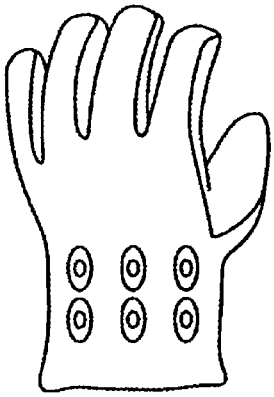
Figure 141:
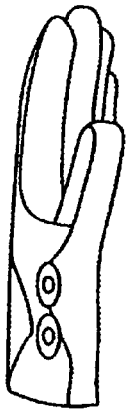
Figure 142:
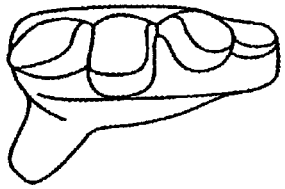
Figure 143:
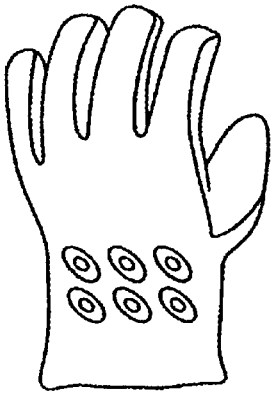
Figure 144:
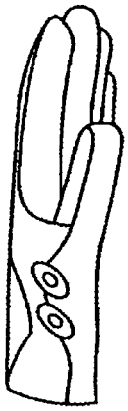

Each group of three figures represents a top, side and front view of the illustrated embodiment. For example, FIG. 44 is a top view of a hand covering illustrating an air conduit in multiple possible locations. The hand covering may include multiple air conduits or may include one air conduit at one of the several illustrated locations. Moreover, an air conduit may be positioned at any other position of the hand covering, whether or not illustrated. FIG. 45 is a side view of the hand covering illustrated in FIG. 44. FIG. 46 is a front view of the hand covering illustrated in FIG. 44.

The hand covering can be manufactured by coupling the first membrane of the air distribution device to the second membrane of the air distribution device to provide the air chamber and air channeling members as described above. The two membranes can be coupled together, for example, by a radio frequency weld adjacent to an edge of each of the first and second membranes, or alternatively, by melting or heat welding the two membranes together. The completed air distribution device is then positioned adjacent the first layer or hand receiving portion of the hand covering and then the second layer or cover is then positioned adjacent the hand receiving portion such that the air distribution device is substantially encapsulated between the first layer and second layer.

The first layer and second layer of the hand covering are then coupled together by, for example, using a single seam. In the embodiment described above in which the air distribution device 450 includes tabs or securing elements 470, 475, the tabs may be sewn along the same seam, or alternatively may be separately attached to the first layer or hand receiving portion. In embodiments in which the hand covering includes an air conduit, the air conduit is coupled adjacent to the inlet of the air distribution device. The air conduit may be coupled directly to the air distribution device, may be coupled to the second layer or cover, or may be coupled to both the air distribution device and the cover.

In embodiments of the invention that include a layer of material between the first and second membrane of the air distribution device, the material is positioned between the two membranes before they are secured together as described above. The material may be positioned throughout the entire air distribution device, or may alternatively be positioned throughout only a portion of the air distribution device.

Figure 41:
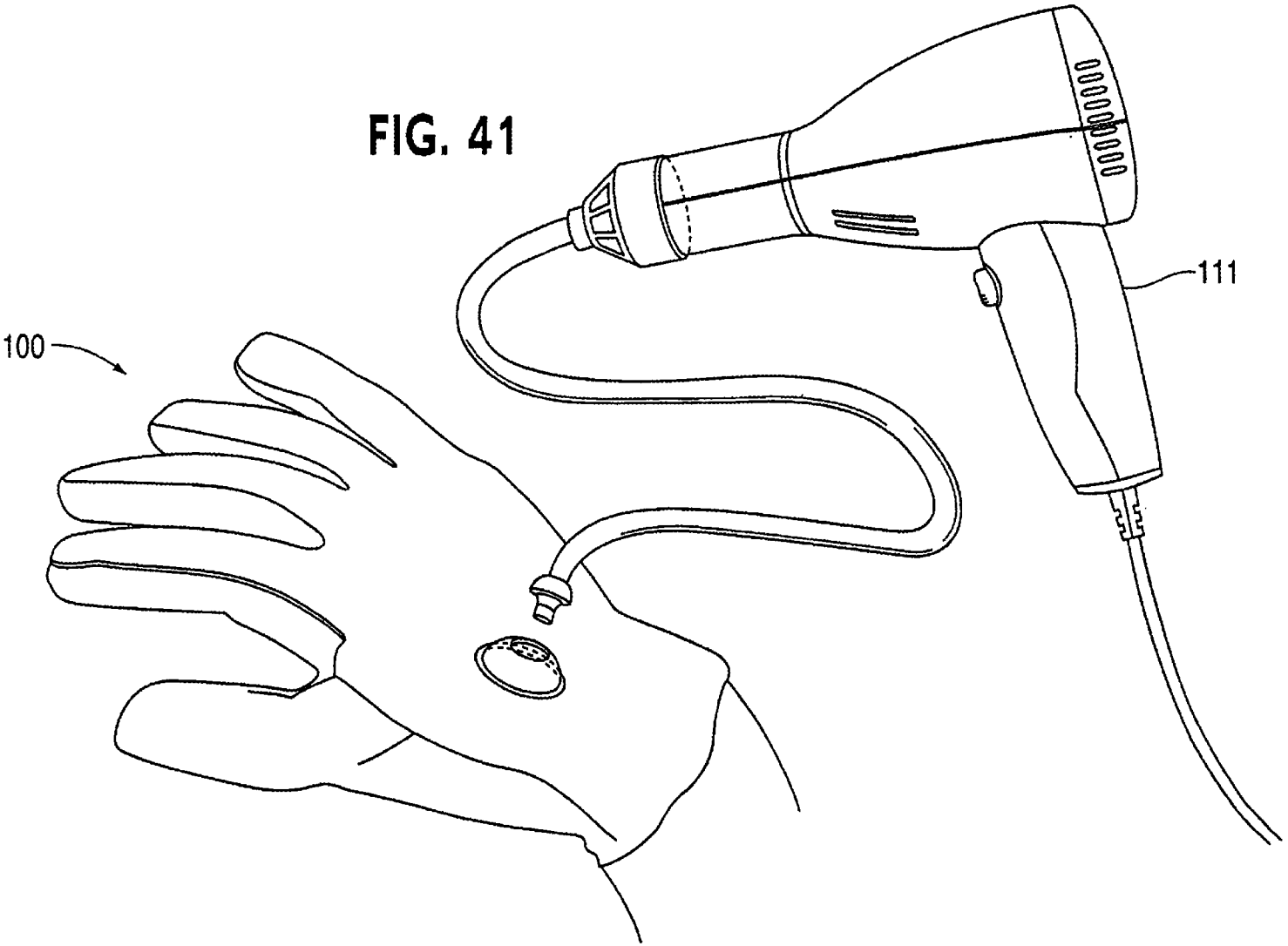
FIG. 41 illustrates a method for providing airflow to the hand covering according to the present invention.

In use, air is distributed to a closed end of the hand covering 100 when pressurized air is received from an air source, such as, for example, a user's mouth. An alternative source of air could be a conventional blow dryer 111 as illustrated in FIG. 41. The pressurized air is then channeled to an air inlet that is defined by the first membrane of the air distribution device and then channeled to the air outlet adjacent to the closed end of the hand covering. The volume of air provided at the inlet is provided at an inlet temperature greater than an ambient temperature (i.e., the user's hand temperature) and is channeled through the air distribution device to the air outlet adjacent the closed end of the hand covering. Substantially all of the volume of air is channeled to the air outlet at a temperature substantially equal to the inlet temperature.

CONCLUSION

While various embodiments of the present invention have been described above, it should be understood that they have been presented by way of example only, and not limitation. Thus, the breadth and scope of the present invention should not be limited by any of the above-described embodiments, but should be defined only in accordance with the following claims and their equivalents.

The previous description of the embodiments is provided to enable any person skilled in the art to make or use the present invention. While the invention has been particularly shown and described with reference to embodiments thereof, it will be understood by those skilled in the art that various changes in form and details may be made therein without departing from the spirit and scope of the invention.

What is claimed is:

1. A hand covering, comprising:

a hand-receiving portion being closed at a first end and defining an opening at a second end;

a cover coupled to the hand-receiving portion; and an air distribution device disposed between the cover and the hand-receiving portion, the air distribution device being substantially planar, the air distribution device having an inlet and an outlet, the inlet and the outlet of the air distribution device being positioned in a spaced apart relation, the outlet configured to exhaust air inwardly towards the hand-receiving portion.

2. The hand covering of claim 1, wherein:

at least one of the cover, the air-distribution device and the hand-receiving portion is a moisture-retaining fabric.

3. The hand covering of claim 1, wherein:

the cover is associated with a moisture-retaining characteristic;

the air-distribution device is associated with a moisture-retaining characteristic; and the hand-receiving portion is associated with a moisture-retaining characteristic, the moisture-retaining characteristic of the hand-receiving portion being less than at least one of the moisture-retaining characteristic of the cover and the moisture-retaining characteristic of the hand-receiving portion.

4. The hand covering of claim 1, wherein:

at least two of the cover, the air-distribution device and the hand-receiving portion are portions of a laminate.

5. The hand covering of claim 1, wherein the air distribution device is configured to communicate air from the inlet to the outlet such that a temperature and a pressure of the air at the inlet are substantially the same as the temperature and the pressure at the outlet.

6. The hand covering of claim 5, wherein the outlet is positioned proximate the first end of the hand receiving portion.

7. The hand covering of claim 1, wherein the air distribution device is configured to communicate air from the inlet to the outlet such that a temperature of the air at the inlet is substantially the same as the temperature at the outlet and a pressure at the inlet is different from the pressure at the outlet.

8. The hand covering of claim 1, wherein the air distribution device includes:

a first membrane defining the inlet;

a second membrane coupled to the first membrane; and the first and second membranes defining an air passage, the outlet located proximate an end of the air passage opposite the inlet.

9. The hand covering of claim 8, wherein the outlet of the air distribution device is defined entirely by the second membrane.

10. The hand covering of claim 8, wherein the outlet of the air distribution device is an opening defined at the end of the air passage.

11. The hand covering of claim 8, wherein the air distribution device further includes:

a material disposed between the first membrane and the second membrane.

12. The hand covering of claim 11, wherein the air distribution device further includes:

a third membrane coupled opposite the second membrane.

13. The hand covering of claim 11, further comprising:

a fabric disposed between the hand receiving portion and the air distribution device.

14. The hand covering of claim 13, wherein the fabric is a heat retaining, moisture retaining fabric.

15. The hand covering of claim 13, wherein the fabric is a moisture removing fabric.

16. The hand covering of claim 8, further comprising:

an air chamber located between the inlet and the air passage.

17. The hand covering of claim 1, wherein:

the cover defines an opening positioned in registry with the inlet of the air distribution device; and an air conduit adjacent the opening and in gaseous communication with the inlet.

18. The hand covering of claim 17, wherein the air conduit is coupled to the cover.

19. The hand covering of claim 17, wherein the air conduit is coupled to the air distribution device.

20. A hand covering, comprising:

a first layer;

a second layer coupled to the first layer;

a plurality of channeling members coupled between the first layer and the second layer, each the channeling member having an inlet and being configured to communicate air to its own outlet, each channeling member from the plurality of channels being substantially planar; and an air intake configured to direct air to each the inlet of the plurality of channeling members.

21. The hand covering of claim 20, wherein:

at least one of the first layer, the second layer and the plurality of channeling members is a moisture-retaining fabric.

22. The hand covering of claim 20, wherein:

the first layer is associated with a moisture-retaining characteristic;

the second layer is associated with a moisture-retaining characteristic; and the plurality of channeling members is associated with a moisture-retaining characteristic, the moisture-retaining characteristic of the second layer being less than at least one of the moisture-retaining characteristic of the first layer and the moisture-retaining characteristic of the plurality of channeling members.

23. The hand covering of claim 20, wherein:

at least two of the first layer, the second layer and the plurality of channeling members are portions of a laminate.

24. The hand covering of claim 20, further comprising:

an air chamber coupled between the first layer and the second layer and having an air chamber inlet, the air chamber positioned between the air intake and each the inlet of the plurality of channeling members.

25. The hand covering of claim 24, further comprising:

a material disposed within the air chamber and each of the plurality of channels.

26. The hand covering of claim 20, wherein each of the plurality of channeling members includes a closed end, the outlet being defined in a side of each of the plurality of channeling members along its length.

27. The hand covering of claim 20, wherein each of the plurality of channeling members has an open end spaced apart from the inlet, the outlet being defined at the open end.

28. The hand covering of claim 20, further comprising:

an air conduit in fluid communication with the air chamber inlet, the second layer defining an opening positioned in registry with the air chamber inlet.

29. The hand covering of claim 28, wherein the air conduit is coupled to the second layer.

30. The hand covering of claim 28, wherein the air conduit is coupled to the air chamber.

31. The hand covering of claim 20, further comprising:

a fabric disposed between the first layer and each of the channeling members.

32. The hand covering of claim 31, wherein the fabric is a heat retaining, moisture retaining fabric.

33. The hand covering of claim 31, wherein the fabric is a moisture removing fabric.

34. A method of manufacturing a hand covering having a first layer, a second layer coupled to the first layer, and an air distribution device disposed between the first layer and the second layer and having a first membrane and a second membrane defining an air inlet and an air outlet positioned in a spaced apart relation, the method comprising:

coupling the first membrane to the second membrane to form the air distribution device, the first membrane and the second membrane each being substantially planar;

positioning the air distribution device adjacent the first layer;

positioning the second layer adjacent the first layer such that the air distribution device is substantially encapsulated between the first layer and the second layer;

coupling the second layer to the first layer; and coupling an air conduit adjacent to the inlet of the air distribution device.

35. The method of claim 34, wherein the coupling the first membrane to the second membrane includes coupling the first membrane to the second membrane with a radio frequency weld adjacent to an edge of each of the first and second membranes.

36. The method of claim 35, wherein the first membrane and the second membrane each include a securing element and the method further includes coupling the securing element between the first layer and the second layer.

37. The method of claim 34, further comprising:

coupling a material between the first membrane and the second membrane.

38. An air distribution apparatus and hand covering combination, comprising:

a hand covering adapted to substantially enclose a hand and having;

a first layer defining a cavity and having a first, open end and a second, closed end; and a second layer coupled to the first layer; and an air distribution apparatus having:

a first membrane substantially planar and defining an inlet;

a second membrane substantially planar and coupled to the first membrane such that a chamber is defined between the first membrane and the second membrane, the second membrane further defining a plurality of outlets in gaseous communication with the chamber and the inlet; and a conduit coupled to the first membrane and configured to be in gaseous communication with the inlet, the air distribution apparatus configured to distribute air from the inlet through the chamber to the plurality of outlets and into the cavity of the first layer.

39. A method of distributing air to a glove having a hand-receiving portion and a cover having an upper portion coupled to the hand-receiving portion, the upper portion of the cover and the hand-receiving portion each being substantially planar and collectively defining an air-distribution device having a chamber, an inlet and an outlet, the inlet and the outlet of the air distribution device being positioned in a spaced apart relation, the method comprising:

receiving pressurized air from an air source;

providing the pressurized air to the air inlet; and channeling the pressurized air through the chamber to the air outlet adjacent an closed end of the hand-receiving portion.

40. The method of claim 39, wherein the providing the pressurized air to the inlet includes providing a volume of air at an inlet temperature greater than an ambient temperature; and the channeling the pressurized air through the chamber to the air outlet adjacent the closed end of the hand-receiving portion includes channeling substantially all of the volume of air to the air outlet at substantially the inlet temperature.

41. A hand covering, comprising:

a hand-receiving portion having a first end and a second end, the hand receiving portion defining a plurality of openings at the first end and an opening at the second end; and an air distribution device substantially planar and coupled to the hand-receiving portion, the air distribution device having an inlet and a plurality of outlets, the inlet and the outlets of the air distribution device being positioned in a spaced apart relation.

42. The hand covering of claim 41, herein:

at least one of the air-distribution device and the hand-receiving portion is a moisture-retaining fabric.

43. The hand covering of claim 41, wherein:

the air-distribution device is associated with a moisture-retaining characteristic; and the hand-receiving portion is associated with a moisture-retaining characteristic, the moisture-retaining characteristic of the hand-receiving portion being less than the moisture-retaining characteristic of the hand-receiving portion.

44. The hand covering of claim 41, wherein:

the air-distribution device and the hand-receiving portion are portions of a laminate.

45. The hand covering of claim 41, wherein the outlets of the air distribution device are substantially coplanar with the plurality of openings at the first end of the hand receiving portion and the inlet of the air distribution device is substantially coplanar with the opening at the second end of the hand-receiving portion.

46. The hand covering of claim 41, wherein the air distribution device is configured to communicate air from the inlet to the outlets such that a temperature and a pressure of the air at the inlet are substantially the same as the temperature and the pressure at the outlets.

47. The hand covering of claim 41, wherein the air distribution device is configured to communicate air from the inlet to the outlets such that a temperature of the air at the inlet is substantially the same as the temperature at the outlet and a pressure at the inlet is different from the pressure at the outlets.

48. The hand covering of claim 41, wherein the air distribution device includes:

a membrane coupled to the hand receiving portion; and the membrane and the hand receiving portion defining the inlet, the outlets and an air passage therebetween.

49. The hand covering of claim 41, wherein the air distribution device includes:

a first membrane;

a second membrane coupled to the first membrane; and the first and second membranes defining the inlet, the outlets and an air passage, the first membrane being coupled to a side of the hand receiving portion.

50. The hand covering of claim 49, wherein the air distribution device further includes:

a material disposed between the first membrane and the second membrane.

51. The hand covering of claim 49, further comprising:

an air chamber located between the inlet and the air passage.

* * * * *